US011578541B2

(12) United States Patent
Ramos et al.

(10) Patent No.: US 11,578,541 B2
(45) Date of Patent: Feb. 14, 2023

(54) MODULAR PIPE LOADER ASSEMBLY

(71) Applicant: The Charles Machine Works, Inc., Perry, OK (US)

(72) Inventors: Pete Ramos, Enid, OK (US); Rick G. Porter, Perry, OK (US); Aleksander S. Wolfe, Stillwater, OK (US)

(73) Assignee: The Charles Machine Works, Inc., Perry, OK (US)

( * ) Notice: Subject to any disclaimer, the term of this patent is extended or adjusted under 35 U.S.C. 154(b) by 166 days.

(21) Appl. No.: 16/901,409

(22) Filed: Jun. 15, 2020

(65) Prior Publication Data

US 2020/0392800 A1 Dec. 17, 2020

Related U.S. Application Data

(60) Provisional application No. 62/861,190, filed on Jun. 13, 2019.

(51) Int. Cl.

| | |
|---|---|
| ***E21B 19/15*** | (2006.01) |
| ***E21B 7/04*** | (2006.01) |
| *E21B 19/20* | (2006.01) |

(52) U.S. Cl.

CPC ..... *E21B 19/15* (2013.01); *E21B 7/046* (2013.01); *E21B 19/20* (2013.01)

(58) Field of Classification Search

CPC ..... E21B 19/14; E21B 19/15; E21B 19/165; E21B 19/20

See application file for complete search history.

(56) References Cited

U.S. PATENT DOCUMENTS

| | | | |
|---|---|---|---|
| 5,556,253 | A | 9/1996 | Rozendaal et al. |
| 6,179,065 | B1 | 1/2001 | Payne et al. |
| 6,332,502 | B1 | 12/2001 | Mills et al. |
| 6,360,830 | B1 | 3/2002 | Price |
| 6,474,931 | B1 | 11/2002 | Austin et al. |
| 6,550,547 | B1 | 4/2003 | Payne et al. |
| 7,011,166 | B2 | 3/2006 | Koch et al. |
| 7,018,164 | B2 | 3/2006 | Anthis et al. |

(Continued)

FOREIGN PATENT DOCUMENTS

WO 2007041822 A1 4/2007

OTHER PUBLICATIONS

Korean Intellectual Property Office "PCT International Search Report" dated Nov. 17, 2015, 3 pages, Republic of Korea.

*Primary Examiner* — Nicole Coy
*Assistant Examiner* — Nicholas D Wlodarski
(74) *Attorney, Agent, or Firm* — Tomlinson McKinstry, P.C.

(57) ABSTRACT

A horizontal directional drilling machine having a modular pipe loader system. The system comprises a first and second pipe loader assembly supported on a drill frame. Each assembly supports a shuttle arm. The shuttle arms are configured to move independently of one another along a shuttle path that is traverse to a longitudinal axis of the drill frame. Movement of each shuttle arm is powered by an actuator supported on each pipe loader assembly. Each pipe loader assembly includes a sensor used to measure parameters related to the position of each shuttle arm relative to the drill frame. A controller analyzes the measured parameters and directs operation of each actuator in order to keep the shuttle arms moving in unison during operation.

18 Claims, 19 Drawing Sheets

(56) References Cited

U.S. PATENT DOCUMENTS

| | | | |
|---|---|---|---|
| 7,240,742 | B2 | 7/2007 | Sewell et al. |
| 7,467,670 | B2 | 12/2008 | Hartke et al. |
| 7,544,036 | B1 | 6/2009 | Randall et al. |
| 7,600,584 | B2 | 10/2009 | Sewell et al. |
| 7,694,751 | B2 | 4/2010 | Hartke |
| 9,127,518 | B1 | 9/2015 | Sewell |
| 9,598,905 | B2 | 3/2017 | Van Zee et al. |
| 10,641,043 | B2 * | 5/2020 | Sevits ..... E21B 7/02 |
| 2001/0022238 | A1 | 9/2001 | Houwelingen et al. |
| 2002/0153169 | A1 | 10/2002 | Sewell |
| 2003/0196791 | A1 | 10/2003 | Dunn et al. |
| 2005/0103526 | A1 | 5/2005 | Ayling |
| 2007/0031215 | A1 | 2/2007 | Belik |
| 2007/0119623 | A1 | 5/2007 | Sewell et al. |
| 2007/0240903 | A1 | 10/2007 | Alft et al. |
| 2009/0095526 | A1 | 4/2009 | Lane et al. |
| 2013/0240269 | A1 | 9/2013 | Novelo et al. |
| 2019/0234158 | A1 | 8/2019 | Porter et al. |

* cited by examiner

MODULAR PIPE LOADER ASSEMBLY

SUMMARY

The present disclosure is directed to an apparatus comprising an elongate frame having a longitudinal axis. The apparatus also comprises a first shuttle arm supported by the frame and movable along a first shuttle path transverse to the longitudinal axis of the frame, and a second shuttle arm supported by the frame and movable along a second shuttle path spaced from, but parallel to, the first shuttle path. The apparatus also comprises a first actuator configured to power movement of the first shuttle arm along the first shuttle path, and a second actuator configured to power movement of the second shuttle arm along the second shuttle path, independent of the first actuator.

The apparatus further comprises a first sensor that periodically measures a first parameter that is either the position of the first shuttle arm or a parameter from which such position may be calculated, and a second sensor that periodically measures a second parameter that is either the position of the second shuttle arm or a parameter from which such position may be calculated. The apparatus even further comprises a controller in communication with the first and second sensors and with the first and second actuators. The controller is configured to evaluate the first and second parameters, and to issue commands to one or both of the first and second actuators in response to that evaluation.

The present disclosure is also directed to a method of using an apparatus. The apparatus comprises an elongate frame having a longitudinal frame axis, a first shuttle arm supported by the frame and movable along a first shuttle path traverse to the frame axis, and a second shuttle arm supported by the frame and movable along a second shuttle path spaced from, but parallel to, the first shuttle path. The method comprises the step of moving each of the first and second shuttle arms relative to the frame, and determining the velocity of each of the first and second shuttle arms at successive positions along their respective shuttle paths. The method further comprises the step of modifying the velocity of one or more shuttle arms in response to the determinations of velocity.

DESCRIPTION

Figure 1:
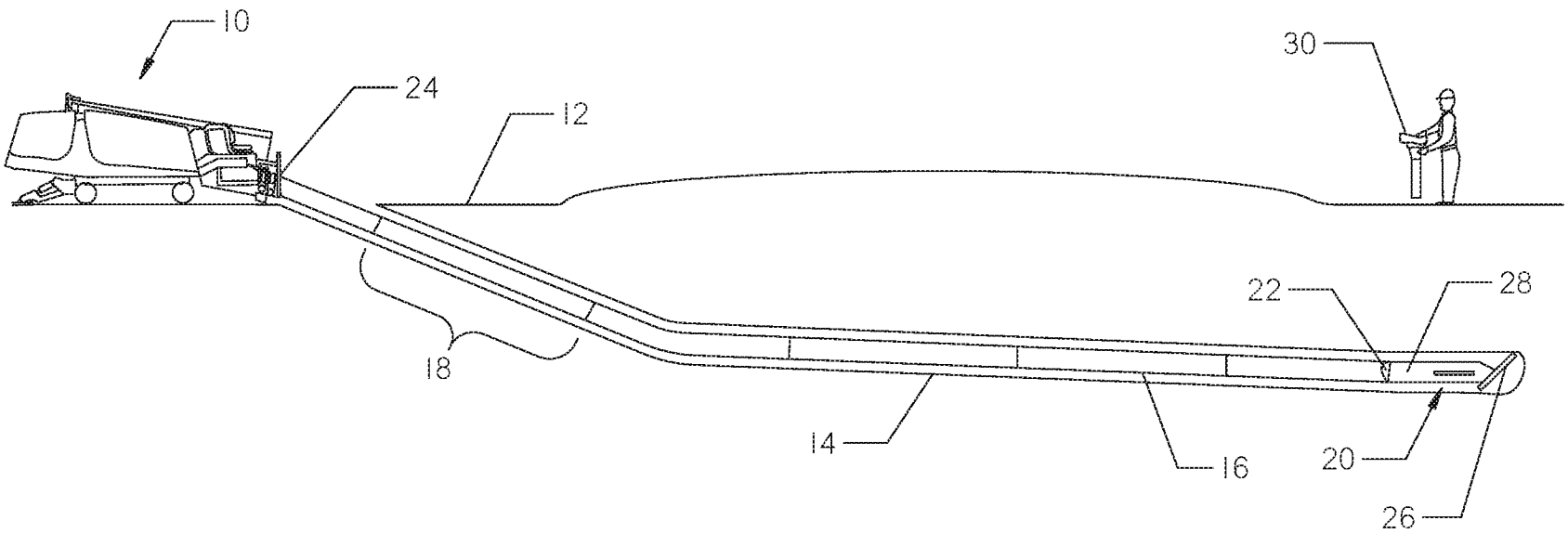
FIG. 1 is an illustration of a horizontal directional drilling system.

Turning now to the figures, FIG. 1 shows a drilling machine 10 sitting on a ground surface 12. The drilling machine 10 is configured for use in a "horizontal boring" or "horizontal directional drilling" operation. The drilling machine 10 is used to create a horizontal borehole 14 below the ground surface 12. The borehole 14 provides space underground for installation of a utility pipeline.

Extending from the drilling machine 10 is a drill string 16. The drill string 16 is made up of a plurality of pipe sections 18 attached end-to-end. The drill string 16 is connected to a downhole tool 20 at its first end 22 and the drilling machine 10 at its second end 24.

The downhole tool 20 comprises a drill bit 26 and a beacon contained within a beacon housing 28. In operation, the drill bit 26 bores underground and advances the downhole tool 20 and the drill string 16 forward, thereby creating the borehole 14. The drilling machine 10 adds the plurality of pipe sections 18 to the drill string 16 as the downhole tool 20 advances underground. An above-ground tracker 30 tracks a signal emitted from the beacon during operation.

Figure 2:
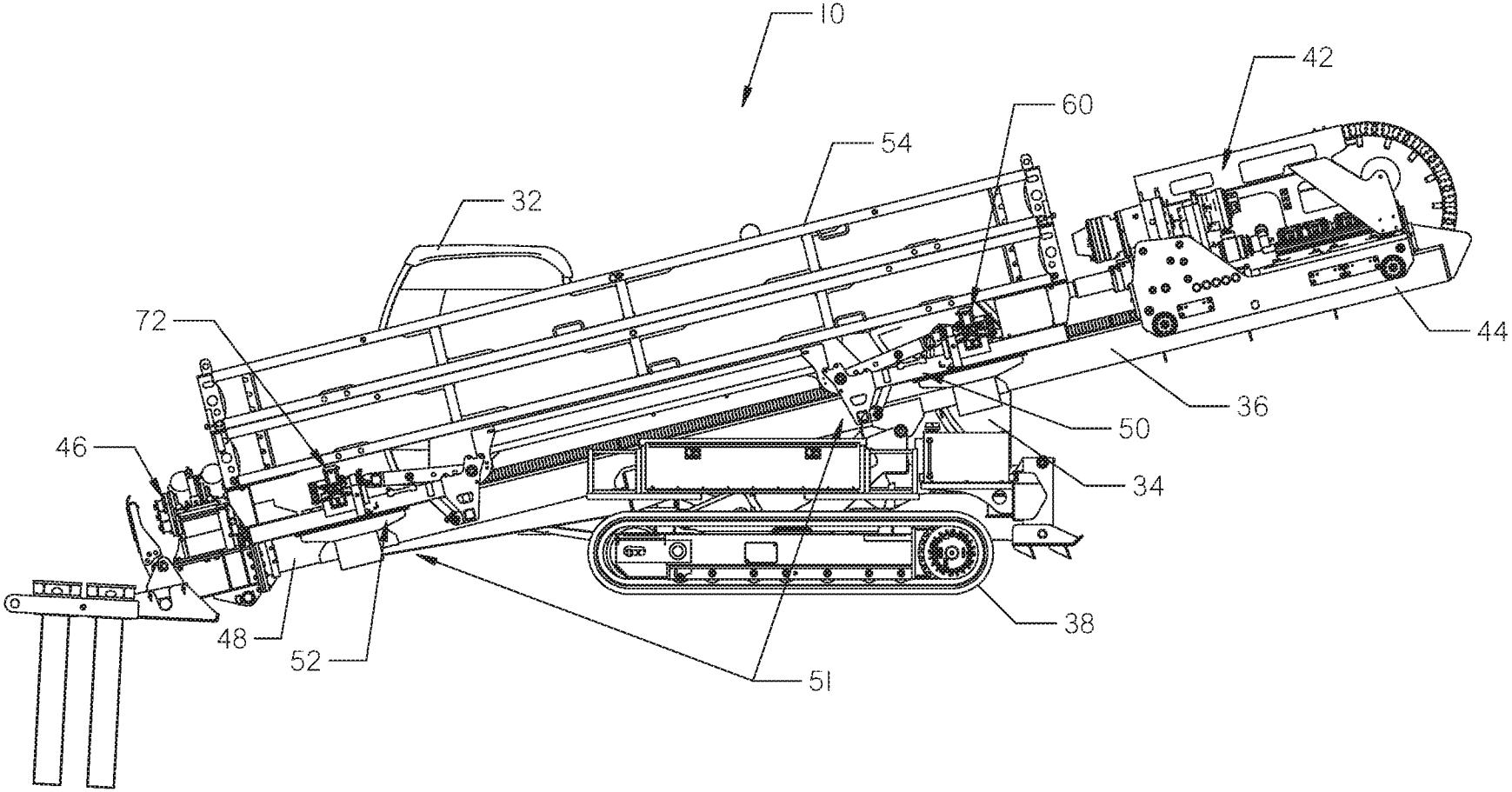
FIG. 2 is a right side elevational view of a drilling machine having a modular pipe loading system.
Figure 3:
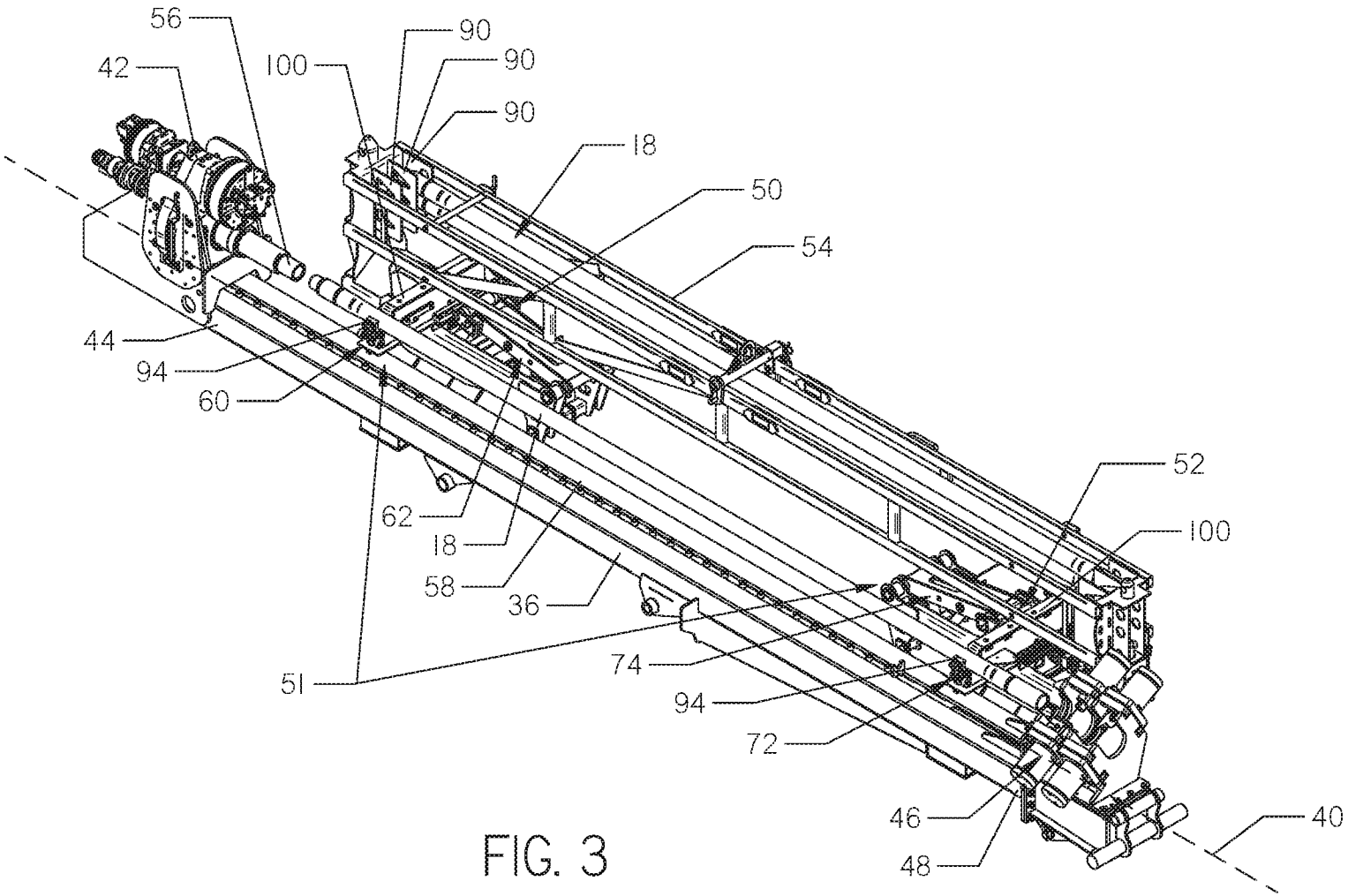
FIG. 3 is a left side perspective view of a portion of the drilling machine shown in FIG. 2. Various components of the drilling machine shown in FIG. 2 have been removed to better view the displayed portion of the drilling machine.

Turning to FIGS. 2 and 3, the drilling machine 10 comprises an operator station 32, engine compartment 34, and an elongate drill frame 36 supported on a pair of endless tracks 38. The drill frame 36 has a longitudinal axis 40, as shown in FIG. 3. The drill frame 36 supports a carriage 42 at its first end 44 and a pair of wrenches 46 at its second end 48.

The drill frame 36 further supports a modular pipe loader assembly 51. The modular pipe loader assembly 51 comprises a first and second pipe loader assembly 50 and 52. As will be described later herein, the first and second pipe loader assemblies 50 and 52 are configured to operate independently of one another.

Continuing with FIGS. 2 and 3, the pipe loader assemblies 50 and 52 support a pipe box 54 housing pipe sections 18. The pipe loader assemblies 50 and 52 and the pipe box 54 are supported adjacent to the drill frame 36 and between the carriage 42 and wrenches 46. The first and second pipe loader assemblies 50 and 52 transport pipe sections 18, shown in FIG. 3, between the carriage 42 and the pipe box 54.

During operation, the carriage 42 uses a rotating spindle 56 and the wrenches 46 to connect pipe sections 18 to or remove pipe sections 18 from the drill string 16. The carriage 42 moves longitudinally along a rail 58 positioned along the drill frame 36 to push and pull the drill string 16 through the ground surface 12.

Figure 4:
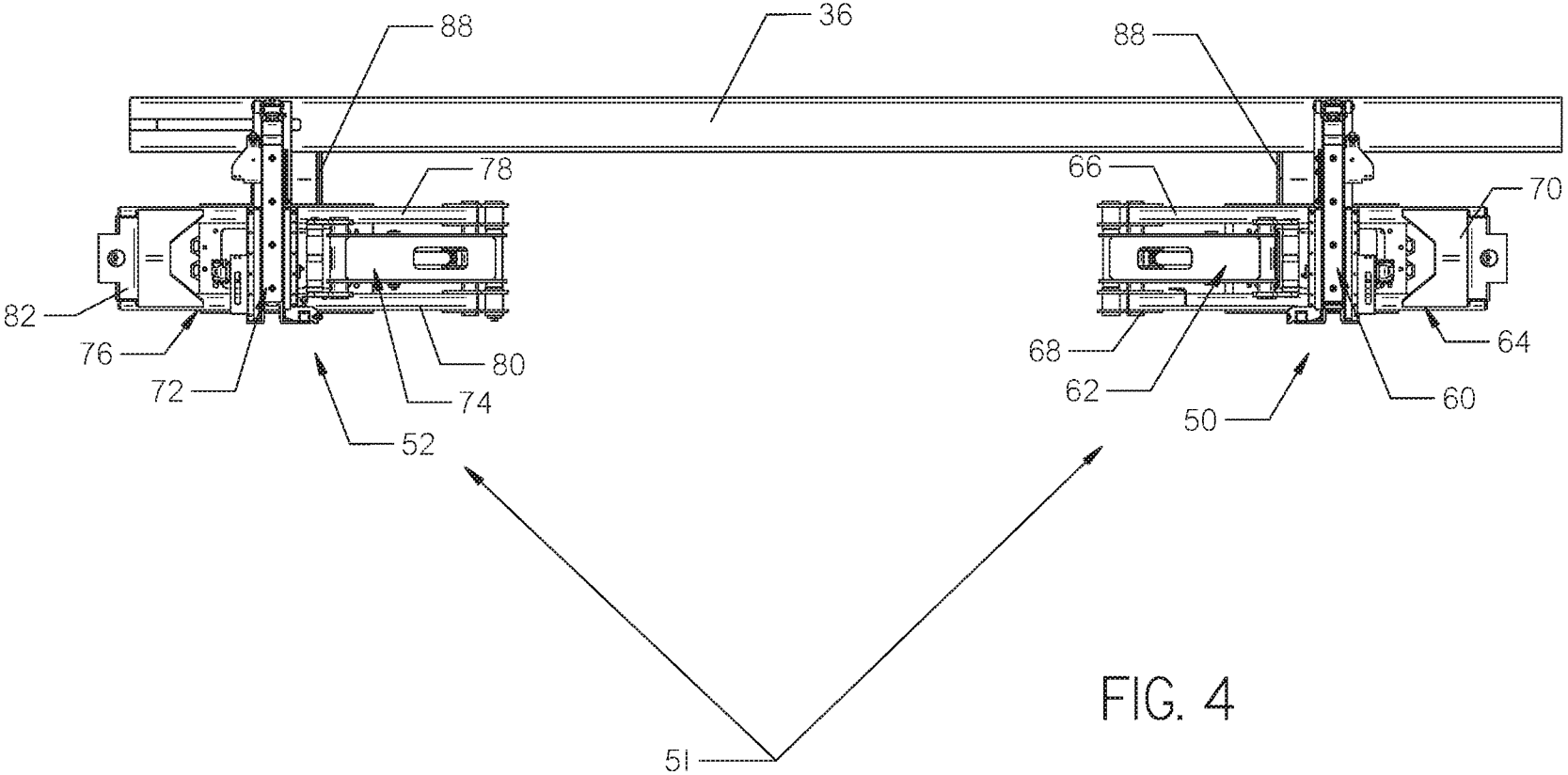
FIG. 4 is a top plan view of the modular pipe loading system shown in FIG. 2. The system is shown supported on a drill frame.
Figure 5:
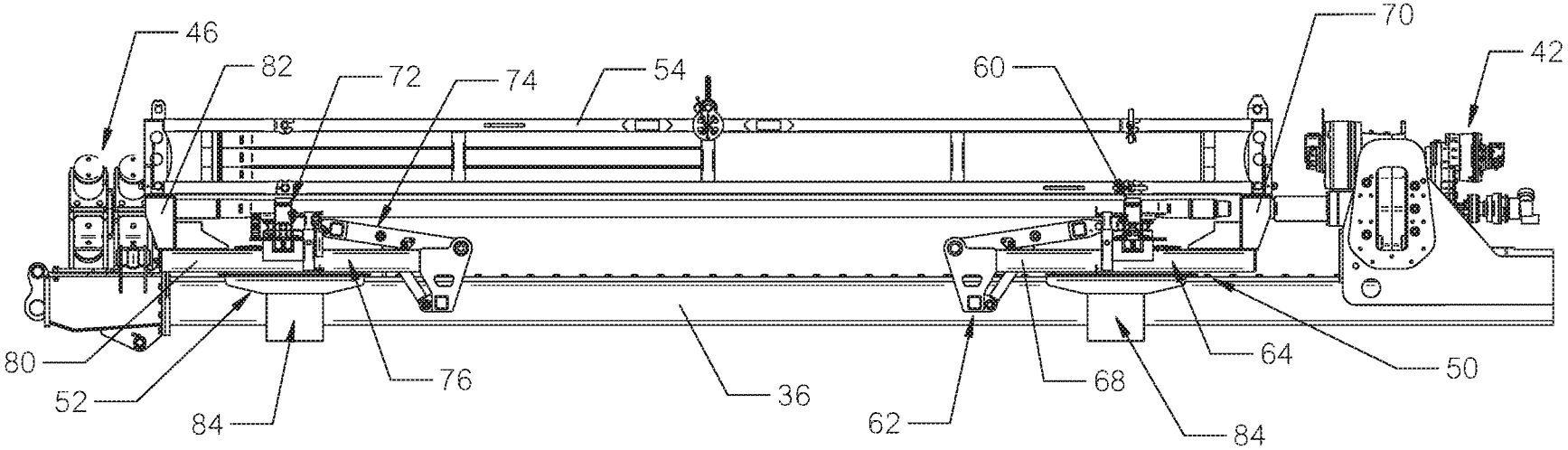
FIG. 5 is right side elevational view of the portion of the drilling machine shown in FIG. 3.

With reference to FIGS. 4 and 5, the first and second pipe loader assemblies 50 and 52 are each supported on the drill frame 36 such that they are parallel and spaced apart from one another. The first pipe loader assembly 50 is positioned adjacent the carriage 42 and the second pipe loader assembly 52 is positioned adjacent the wrenches 46.

The first pipe loader assembly 50 comprises a first shuttle arm 60 and a first lift assembly 62 supported on a first pipe loader frame 64. The first pipe loader frame 64 comprises a front support 66 and a rear support 68. Such supports 66 and 68 are positioned parallel to the drill frame 36 and are joined at a first end of the frame 64 by a bracket 70. The supports 66 and 68 are joined at a second end of the frame 64 by the first lift assembly 62.

The second pipe loader assembly 52 comprises a second shuttle arm 72 and a second lift assembly 74 supported on a second pipe loader frame 76. The second pipe loader frame 76 comprises a front support 78 and a rear support 80. Such supports 78 and 80 are positioned parallel to the drill frame 36 and are joined at a first end of the frame 76 by the second lift assembly 74. The supports 78 and 80 are joined at a second end of the frame 76 by a bracket 82.

The lift assemblies 62 and 74 are configured to move pipe sections 18 between the pipe box 54 and the shuttle arms 60 and 72. The shuttle arms 60 and 72 are configured to move pipe sections 18 between the carriage 42 and the lift assemblies 62 and 74.

Figure 6:
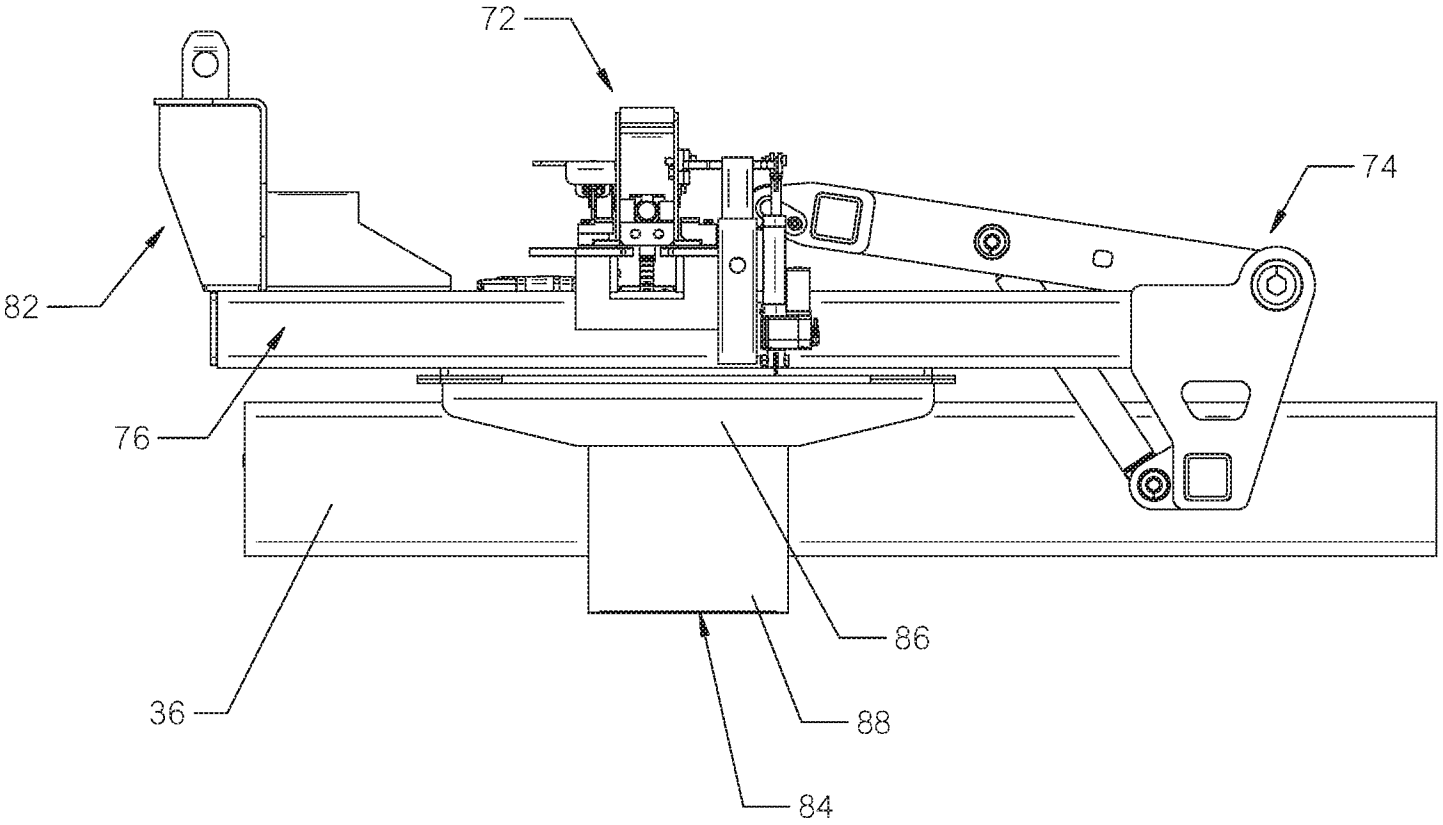
FIG. 6 is a right side elevational view of a second pipe loader assembly used with the modular pipe loading system shown in FIG. 2.
Figure 7:
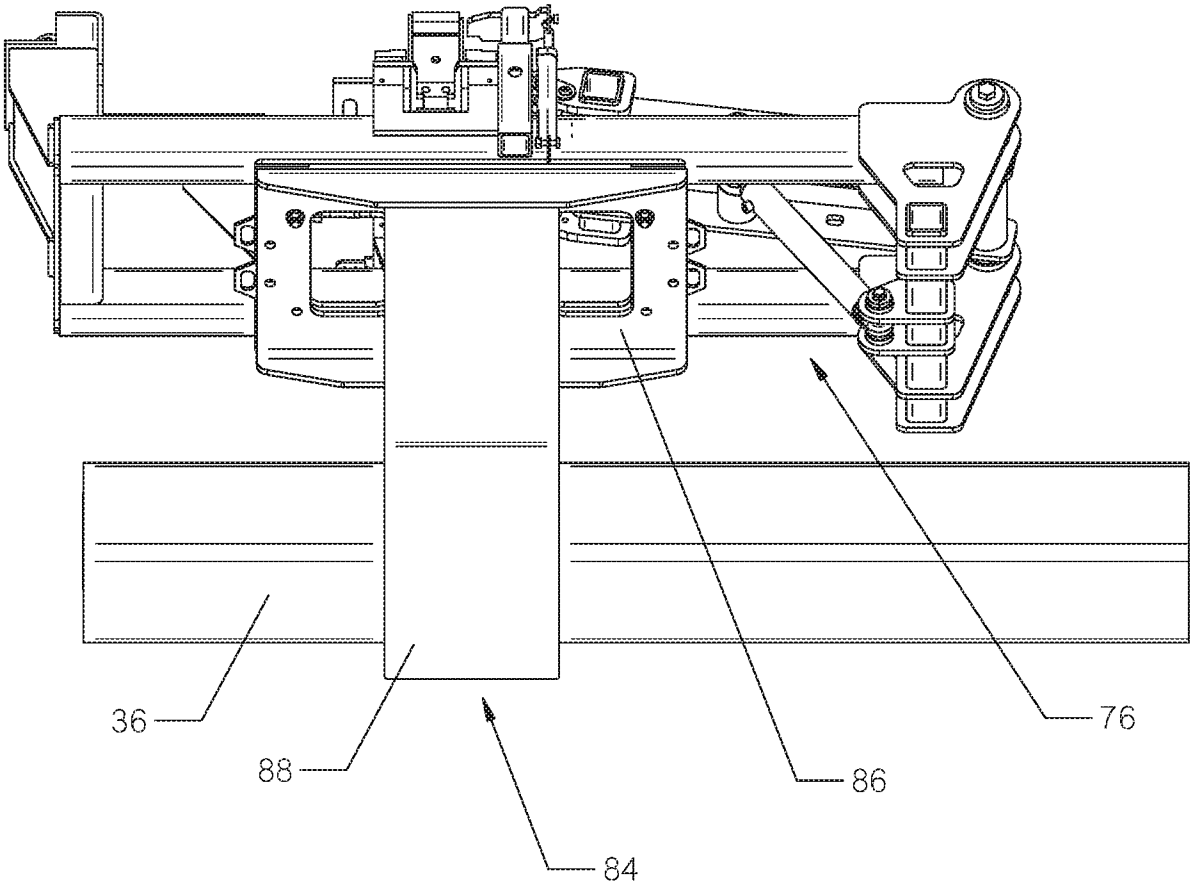
FIG. 7 is a bottom perspective view of the second pipe loader assembly shown in FIG. 6.

With reference to FIGS. 5-7, each of the first and second pipe loader frames 64 and 76 is attached to the drill frame 36 by a mount 84. Each mount 84 comprises a top plate 86 attached to an arm 88. The arms 88 are each attached to the drill frame 36 and project from the side of the drill frame 36, as shown in FIG. 4. The top plate 86 is attached to the projecting end of each of the arm 88. Each of the pipe loader frames 64 and 76 is supported on one of the top plates 86, as shown in FIG. 7.

Turning back to FIG. 5, the pipe box 54 is supported on each of the pipe loader assemblies 50 and 52. The pipe box 54 attaches to each of the brackets 70 and 82 such that it is suspended above the shuttle arms 60 and 72 and the lift assemblies 62 and 74. A plurality of dividers 90 are positioned at opposite ends of the interior of the pipe box 54, as shown in FIG. 3. The dividers 90 create columns within the pipe box 54 for storage of the pipe sections 18. The pipe box 54 shown in FIGS. 2, 3, and 5 includes three columns. In alternative embodiments, the pipe box may include more than three columns or less than three columns.

Continuing with FIGS. 5-7, the mounts 84 of each pipe loader frame 64 and 76 are attached to the drill frame 36 by multiple welds. In alternative embodiments, the mounts may be attached to the drill frame with bolts, spring loaded pins, or the like, allowing the mounts to be selectively positioned along the length of the drill frame. Selectively positioning the mounts along the frame allows the drilling machine to be modified to accommodate different sizes of pipe sections. For example, if the drilling machine is originally configured for use with a pipe box sized to store 20-foot pipe sections, the mounts may be moved closer together so as to accommodate a pipe box sized to store 15-foot pipe sections. The drilling machine may be configured so as to operate with various sizes of pipe sections.

Figure 8:
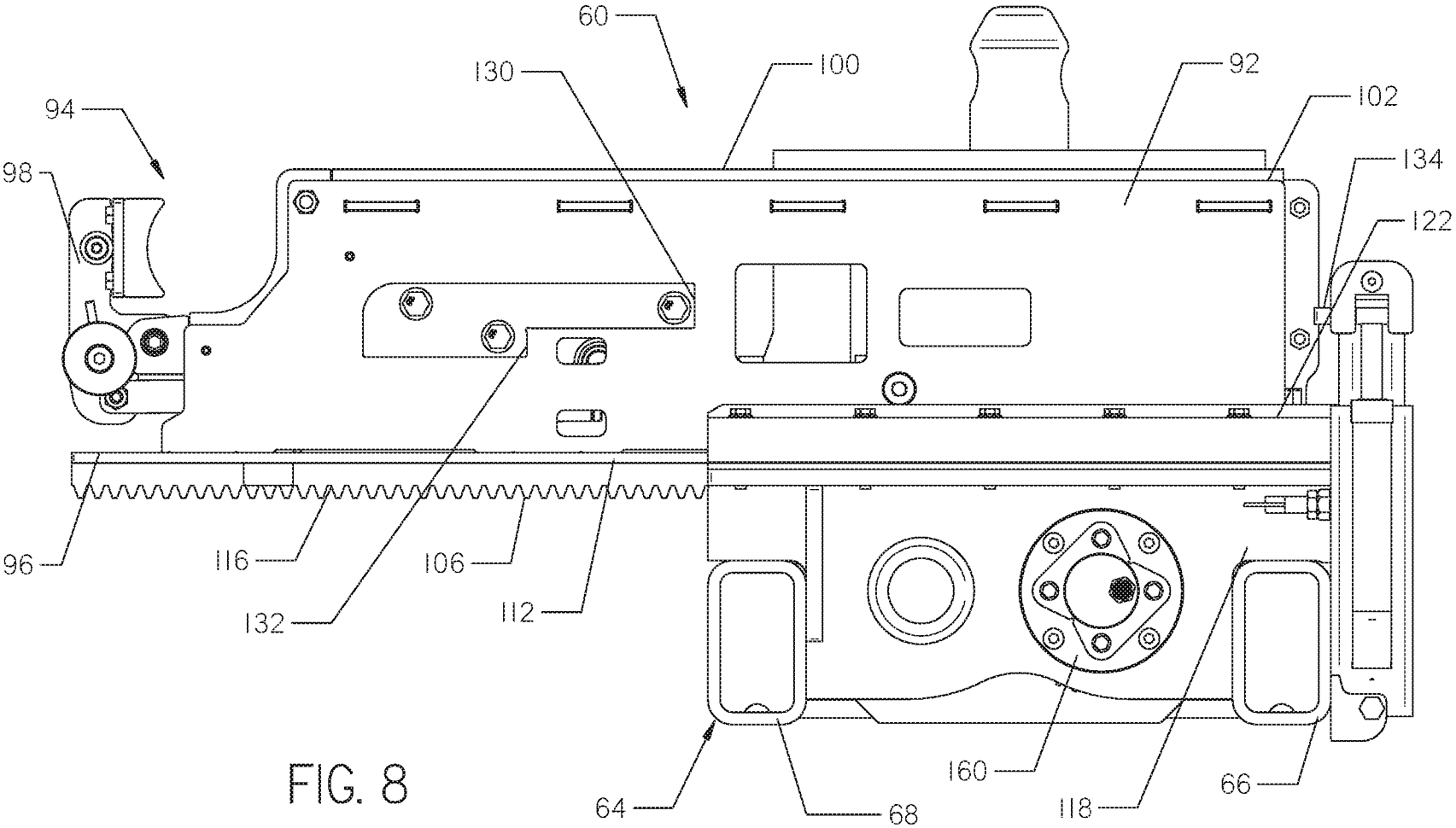
FIG. 8 is a left side elevational view of a first shuttle arm supported on a first pipe loader assembly used with the modular pipe loading system shown in FIG. 2. A portion of the first pipe loader assembly has been removed to expose a first sensor.

With reference to FIG. 8, each of the shuttle arms 60 and 72 comprises an elongate body 92 having a gripper 94 formed at its forward end 96. The gripper 94 comprises an arm 98 configured to move towards and away from the body 92. The gripper 94 is configured to releasably hold a pipe section 18 via movement of the arm 98. Each shuttle arm 60 and 72 further comprises a shuttle pad 100 attached to its upper side 102 and extending along its length. The shuttle pads 100 provide a surface to support pipe sections 18 that are lowered from the pipe box 54 by the lift assemblies 62 and 74.

Figure 9:
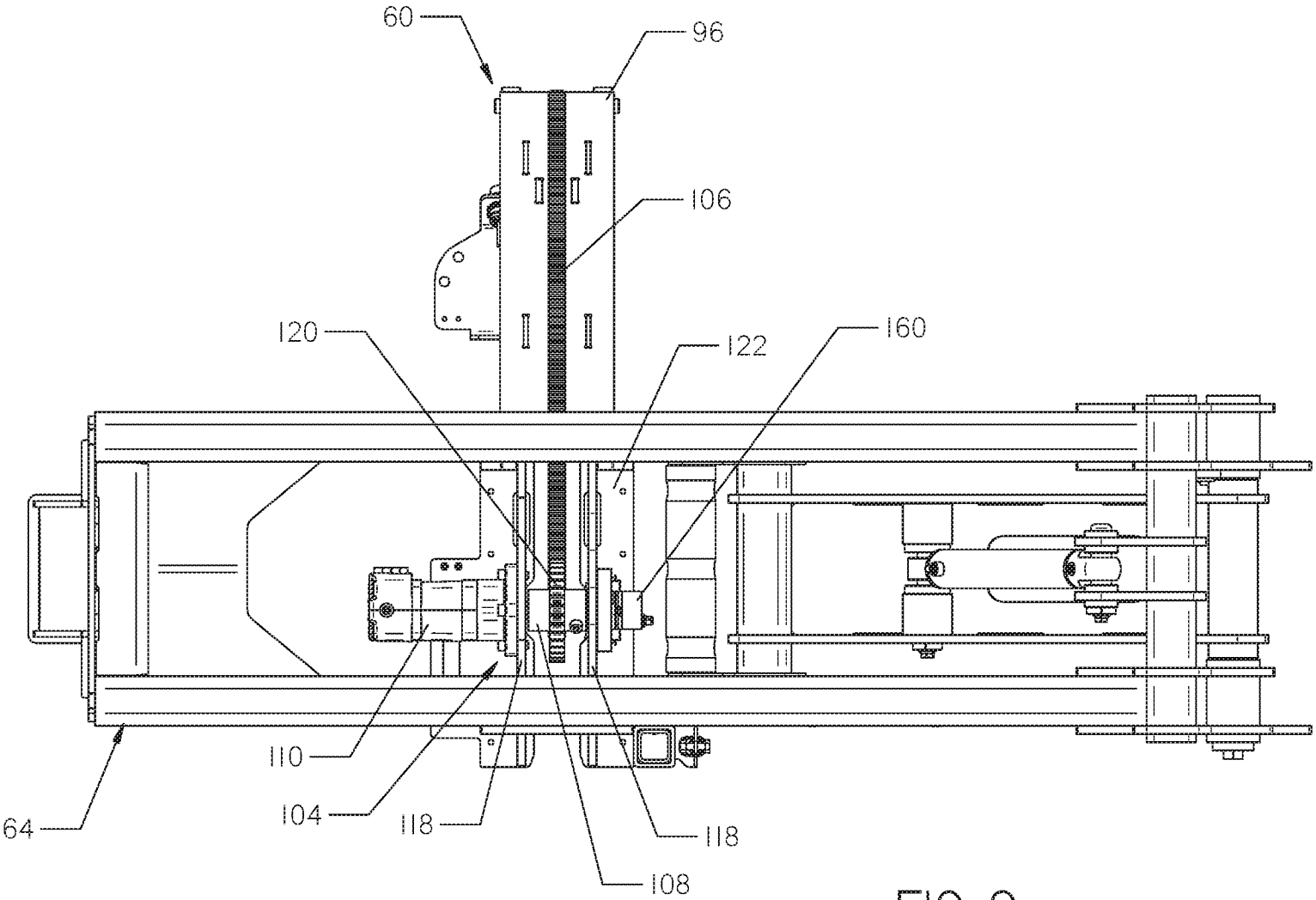
FIG. 9 is a bottom plan view of the first pipe loader assembly used with the modular pipe loading system shown in FIG. 2.
Figure 10:
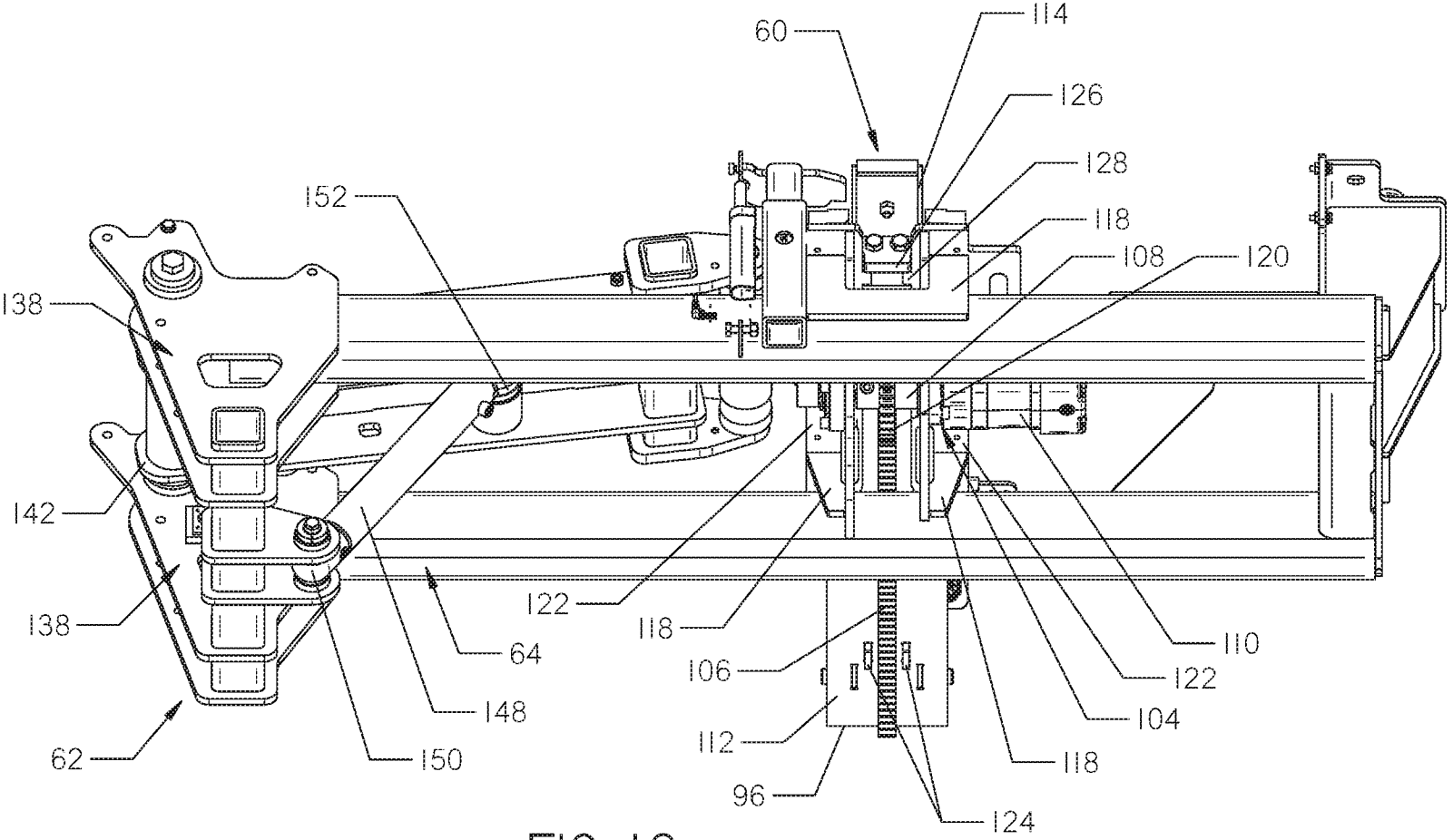
FIG. 10 is a bottom perspective view of a rearward end of the pipe loader assembly shown in FIG. 9.

With reference to FIGS. 9 and 10, the shuttle arms 60 and 72 are moved using an actuator 104. The actuator 104 shown in FIG. 9 comprises a rack 106 and a pinion gear 108 powered by a hydraulic motor 110. In alternative embodiments, the actuator may comprise a hydraulic cylinder. Each pinion gear 108 is mounted on each pipe loader frame 64 and 76 beneath its corresponding shuttle arm 60 and 72.

Figure 11:
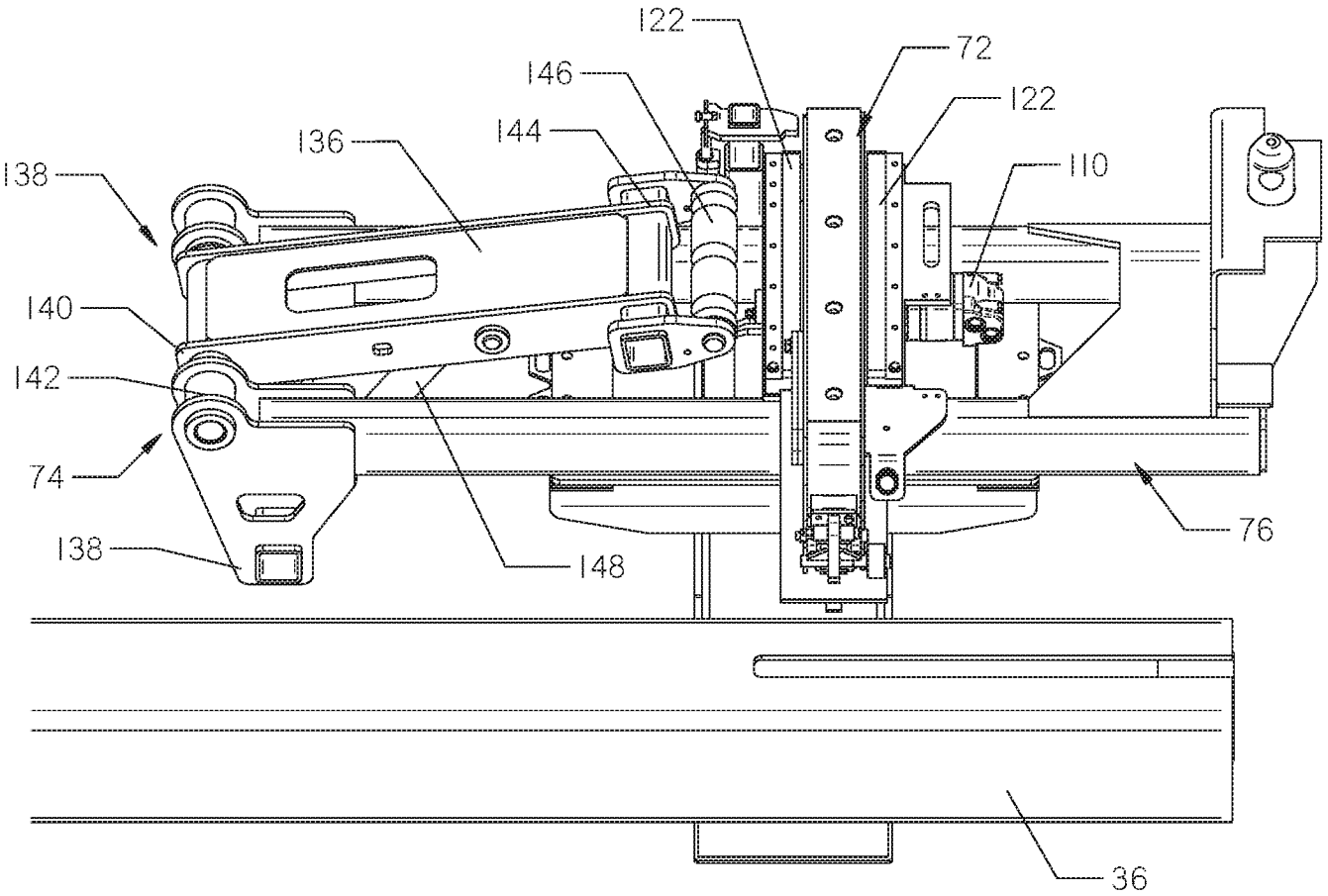
FIG. 11 is a front perspective view of the second pipe loader assembly shown in FIG. 6.

Each pinion gear 108 and hydraulic motor 110 are supported by a set of brackets 118, which are in turn supported on their corresponding pipe loader frame 64 and 76. The brackets 118 further support a set of guides 122 positioned on opposite sides of the shuttle arms 60 and 72, as shown in FIG. 11. The guides 122 secure each shuttle arm 60 and 72 to its corresponding pipe loader frame 64 and 76.

Turning back to FIG. 8, each of the shuttle arms 60 and 72 includes the rack 106, which is an elongate metal structure either formed in or attached to a lower side 112 of each shuttle arm 60 and 72. Each rack 106 extends between forward and rearward ends 96 and 114, and preferably extends along the greater part of the length of its associated shuttle arm 60 and 72, as shown in FIGS. 9 and 10. A plurality of longitudinally aligned grooves 116 are formed in the underside of each rack 106.

Turning back to FIGS. 9 and 10, a plurality of teeth 120 are formed around the periphery of each pinion gear 108. The grooves 116 of each rack 106 mate with the teeth 120 of each pinion gear 108. Rotation of each pinion gear 108 causes each shuttle arm 60 and 72 to move longitudinally relative to its corresponding pipe loader frame 64 and 76. Rotation of each pinion gear 108 is driven by its corresponding hydraulic motor 110.

The pinion gears 108 may rotate in a clockwise or counter-clockwise direction. Clockwise rotation of the pinion gears 108 moves the shuttle arms 60 and 72 rearwardly away from the carriage 42. Counter-clockwise rotation of the pinion gears 108 moves the shuttle arms 60 and 72 forward towards the carriage 42.

Turning back to FIG. 10, each of the shuttle arms 60 and 72 includes a set of front stops 124 and a rear stop 126. The front stops 124 are formed on the lower side 112 of each shuttle arm 60 and 72 and comprise two tabs positioned on opposite sides of the rack 106. The front stops 124 are configured to engage with ledges (not shown) formed at a rear end of the guides 122. The front stops 124 engage with the ledges as the shuttle arms 60 and 72 move rearwardly and stop movement of the shuttle arms 60 and 72 beneath the third or last column of the pipe box 54.

The rear stop 126 is a tab attached to the rearward end 114 of the shuttle arms 60 and 72. The rear stop 126 is configured to engage with a notch 128 formed on the set of brackets 118 as the shuttle arms 60 and 72 are moved forward towards the carriage 42. Such engagement stops movement of the shuttle arms 60 and 72 once each shuttle arm's gripper 94 is aligned with the spindle 56.

In operation, the first shuttle arm 60 moves between its front and rear stops 124 and 126 along a first shuttle path. Likewise, the second shuttle arm 72 moves between its front and rear stops 124 and 126 along a second shuttle path. Both paths are transverse to the longitudinal axis of the first and second pipe loader frames 64 and 76 and the longitudinal axis 40 of the drill frame 36.

Turning back to FIG. 8, each shuttle arm 60 and 72 further includes a first stop 130 and a second stop 132. Such stops 130 and 132 comprise a stepped tab attached to the side of each of the shuttle arms 60 and 72. The stops 130 and 132 are configured to engage with a vertically adjustable bolt 134. The bolt 134 may comprise a flat plate joined to an elongate arm. Engagement of the bolt 134 with the first stop 130 stops movement of the shuttle arms 60 and 72 beneath the first column of the pipe box 54. Engagement of the bolt 134 with the second stop 132 stops movement of the shuttle arms 60 and 72 beneath the second column of the pipe box 54. In alternative embodiments, the shuttle arms may include more or less stops, depending on the number of columns included in the pipe box.

Continuing with FIGS. 10 and 11, the first and second lift assemblies 62 and 74 each comprise an arm 136 pivotally attached to two sets of brackets 138 via a pin 142. The pin 142 and the brackets 138 join the front and rear supports 66 and 68 or 78 and 80 of the corresponding pipe loader frame 64 or 76. A first end 140 of the arm 136 is pivotally attached to the pin 142 and brackets 138, and a second end 144 of the arm 136 is positioned adjacent its corresponding shuttle arm 60 or 72. A roller 146 is attached to the second end 144 of the arm 136. The width of the roller 146 corresponds with the width of the pipe box 54. The roller 146 supports the pipe sections 18 as they are transported between the pipe box 54 and the shuttle arms 60 and 72.

The first and second lift assemblies 62 and 74 each further comprise a hydraulic cylinder 148. A first end 150 of the hydraulic cylinder 148 is attached to the brackets 138 and a second end 152 is attached to the lower side of the arm 138. Extension and retraction of the hydraulic cylinder 148 raises and lowers the arm 138. The hydraulic cylinder 148 includes a sensor configured to track the position of the cylinder's piston during operation. Thus, the hydraulic cylinder may be referred to as a "smart cylinder". The sensor may communicate with a controller or processor located at the drilling machine's operator station 32.

The hydraulic cylinders 148 raise and lower the arms 138 in a radial motion. Thus, the lift assemblies 62 and 74 are considered "radial lift assemblies". In alternative embodiments, the pipe loader assemblies may use vertical lift assemblies, like those described in U.S. Patent Publication No. 2019/0234158, authored by Porter et al. The size of the lift assemblies may vary depending on the size of the drilling machine, pipe box, and pipe sections.

Turning back to FIG. 3, to unload pipe sections 18 from the pipe box 54, the lift assemblies 62 and 74 are initially in the raised position, holding the pipe sections 18 within the pipe box 54. The shuttle arms 60 and 72 are positioned so that each of the grippers 94 is directly beneath the first column of the pipe box 54. Once the grippers 94 are in position, the lift assemblies 62 and 74 are moved to a lowered position. The pipe sections 18 in the pipe box 54 will lower with the lift assemblies 62 and 74. The lift assemblies 62 and 74 move lower than the height of the shuttle arms 60 and 72 when moving to the lowered position. Thus, the path of travel of the pipe sections 18 is interrupted by the shuttle arms 60 and 72 as the lift assemblies 62 and 74 lower. Such interruption causes the pipe section 18 from the first column to lower into the grippers 94 and the pipe sections 18 from the second and third columns to rest on the shuttle pads 100.

Once a pipe section 18 is securely held in the grippers 94, the shuttle arms 60 and 72 will move slightly forward so the grippers 94 clear a front edge of the lift assemblies 62 and 74. The shuttle arms 60 and 72 will slide underneath the pipe sections 18 resting on the shuttle pads 100 as the shuttle arms 60 and 72 move forward. A bottom edge of the pipe box 54 will prevent the pipe sections 18 resting on the shuttle pads 100 from moving with the shuttle arms 60 and 72. Once the grippers 94 holding the pipe section 18 have cleared the lift assemblies 62 and 74, the lift assemblies 62 and 74 will move to their raised positions. Pipe sections 18 remaining within the pipe box 54 are raised into the pipe box 54 as the lift assemblies 62 and 74 are raised.

When unloading pipe sections 18 from the pipe box 54, the first column must be completely unloaded before moving to the second column, and so on. Otherwise, pipe sections 18 would fall from the pipe box 54 as the lift assemblies 62 and 72 move to the lowered position.

To load pipe sections 18 into the pipe box 54, the lift assemblies 62 and 74 are initially in a lowered position. The shuttle arms 60 and 72 retrieve a pipe section 18 from the carriage 42 and move rearwardly so that the grippers 94 are positioned directly beneath the third column. Once the pipe section 18 is directly beneath the third column of the pipe box 54, the lift assemblies 62 and 74 will move to a raised position and pick up the pipe sections 18 along the way. The shuttle arms 60 and 72 will then move forward and retrieve another pipe section 18 from the carriage 42.

Once a new pipe section 18 is in the grippers 94, the lift assemblies 62 and 74 will move to a lowered position so that the pipe section 18 within the third column will rest on the shuttle pads 100. The shuttle arms 60 and 72 will then move rearwardly, sliding underneath the pipe section 18 resting on the shuttle pads 100. Once the grippers 94 reach a position beneath the third column of the pipe box 54, the pipe section 18 on the shuttle pads 100 will fall on top of the pipe section 18 held within the grippers 94. The lift assemblies 62 and 74 are then moved to a raised position, lifting both of the pipe sections 18 into the third column of the pipe box 54. The shuttle arms 60 and 72 may then move forward to retrieve another pipe section 18 from the carriage 42. This process continues until the third column of the pipe box 54 is full of pipe sections 18.

When loading pipe sections 18 into the pipe box 54, the third or last column must be completely filled before moving to the second column, and so on. Otherwise, pipe sections 18 would fall from the pipe box 54 as the lift assemblies 62 and 74 move to a lowered position.

Continuing with FIGS. 2 and 3, in operation, it is important that the shuttle arms 60 and 72 operate in unison when transporting a pipe section 18. The pinion gears used with traditional shuttle arms are interconnected by a shaft so that the gears operate in unison. However, the shaft used to interconnect the gears is typically heavy and adds extra weight to the drilling machine.

The drilling machine 10 shown in FIGS. 2 and 3 does not have a shaft interconnecting the pinion gears 108. Thus, the pinion gears 108 are not mechanically coupled, apart from a pipe section 18 extending between the shuttle arms 60 and 72. Not having a shaft extending between the pinion gears 108 removes excess weight from the drilling machine 10 and provides more space for other components, such as a tool box or fuel tank. As described below, the drilling machine 10 is configured so that the first and second shuttle arms 60 and 72 operate in unison without the use of a shaft interconnecting the pinion gears 108.

Turning back to FIGS. 8, 9 and 12, a first and second sensor 160 and 162 are used to track the position of the shuttle arms 60 and 72 along the first and second shuttle path. Parameters measured by the sensors 160 and 162 are transmitted to a controller. The controller analyzes the received parameters and directs operation of the actuators 104 in order to keep the shuttle arms 60 and 72 aligned as they move along their shuttle paths. The controller may comprise a computer processor supported at the drilling machine's operator station 32. Alternatively, the controller may comprise a computer processor positioned remote from the drilling machine 10.

Figure 12:
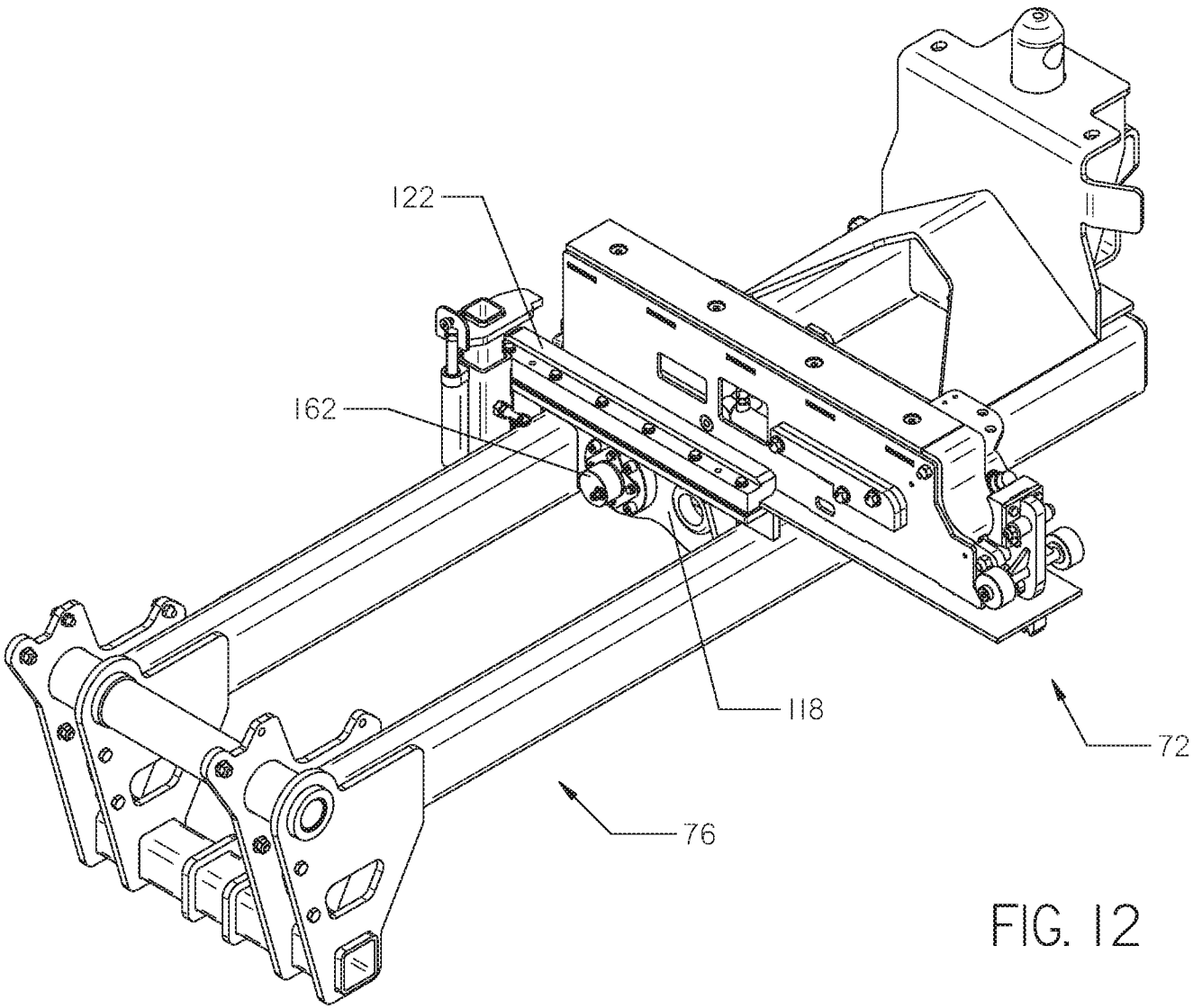
FIG. 12 is a left side perspective view of the first pipe loader assembly shown in FIG. 9. The first lift assembly has been removed to expose the first sensor.

The first sensor 160 is attached to the brackets 118 opposite the hydraulic motor 110 on the first pipe loader frame 64, as shown in FIGS. 8 and 9. Likewise, the second sensor 162 is attached to the brackets 118 opposite the hydraulic motor 110 on the second pipe loader frame 76, as shown in FIG. 12. The first sensor 16 periodically measures a first parameter of the first shuttle arm 60, while the second sensor 162 periodically measures a second parameter of the second shuttle arm 72. The first and second parameters measured may be the position of the first and second shuttle arm 60 and 72 along their shuttle paths. Alternatively, the first and second parameters may be a parameter from which the position of the first and second shuttle arm 60 and 72 along their shuttle paths may be calculated.

Continuing with FIGS. 8, 9 and 12 each of the first and second sensors 160 and 162 comprises a non-contact absolute rotary encoder. During operation, the encoders track the position of the shuttle arms 60 and 72 relative to their respective pinion gears 108. The encoders apply a value to various positions of the shuttle arms 60 and 72 along their shuttle paths. The encoders operate without the need for a reference point to recalibrate the encoder. The encoders are considered non-contact because they do not directly engage the pinion gears 108 or shuttle arms 60 and 72. The absolute rotary encoder may comprise a magnetic, optical, or other type of non-contact encoder known in the art.

Figure 13:
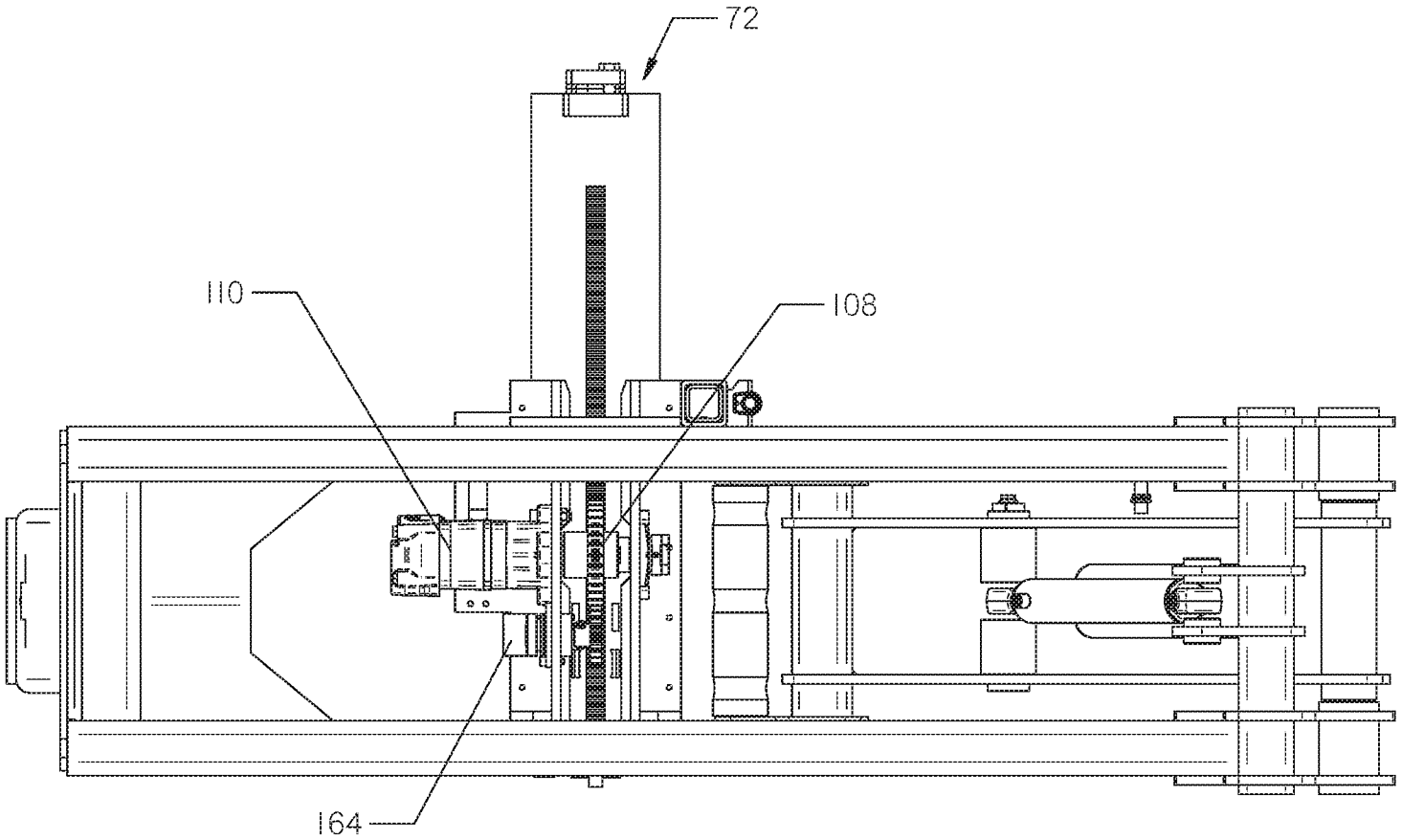
FIG. 13 is a bottom plan view of the second pipe loader assembly shown in FIG. 6, using an alternative embodiment of a sensor.
Figure 14:
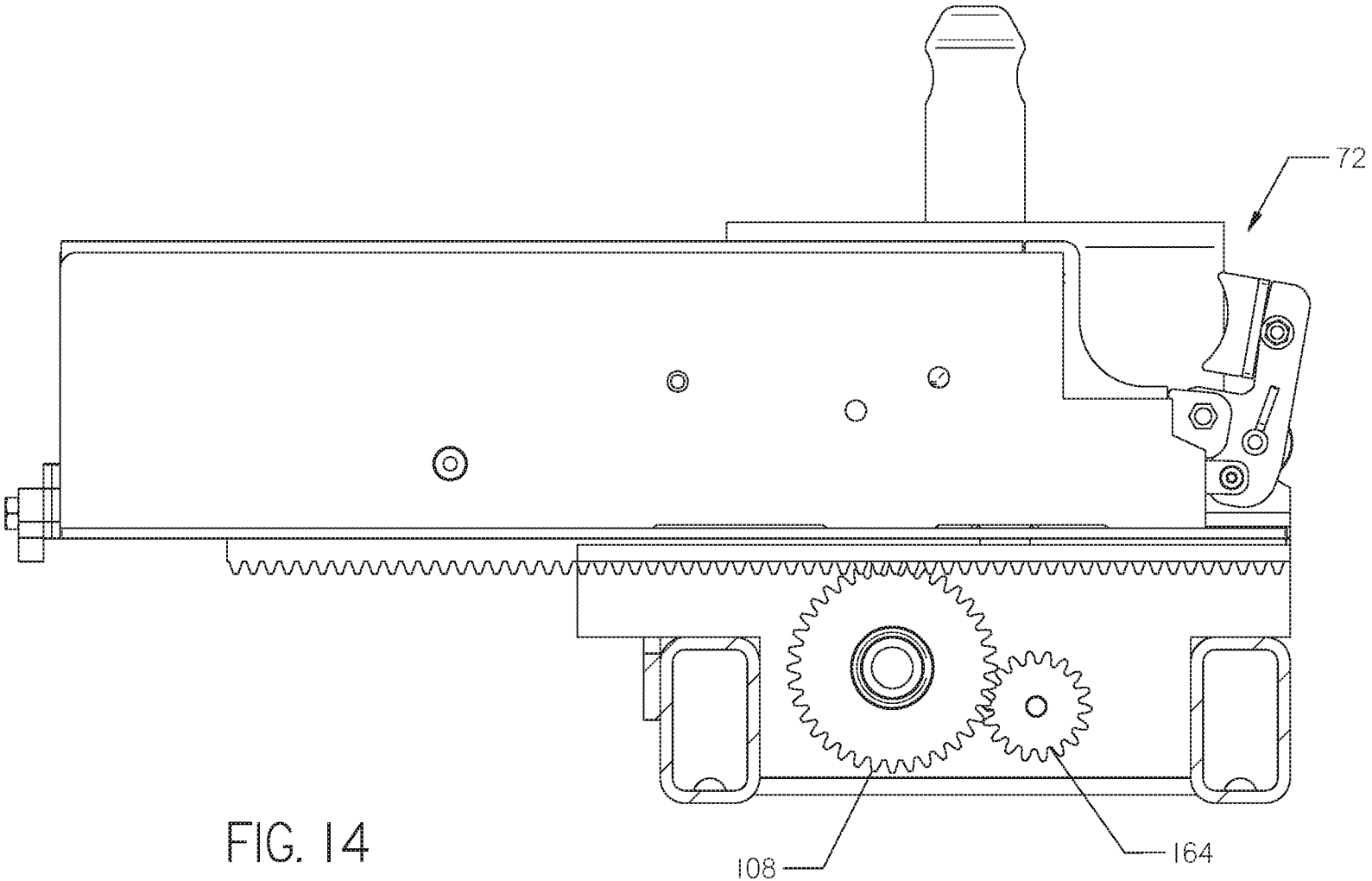
FIG. 14 is a right side elevational view of the second pipe loader assembly shown in FIG. 13. Portions of the assembly and sensor have been removed to expose the sensor.

Turning to FIGS. 13 and 14, an alternative embodiment of a sensor 164 is shown. The sensor 164 may be used in place of the non-contact sensors 160 or 162. The sensor 164 comprise a contact absolute rotary encoder. The sensor 164 is considered a contact encoder because it is directly engaged to the pinion gear 108. Like the sensors 160 and 162, the sensor 164 applies a value to various positions of the shuttle arms 60 and 72 along their shuttle paths. In alternative embodiments, the sensor may comprise any form of a contact or mechanical rotary encoder known in the art.

In an alternative embodiment, an incremental encoder may be used rather than an absolute rotary encoder. The incremental encoder may be used in conjunction with a proximity sensor. The proximity sensor may serve as a reference point for calibrating the incremental encoder.

In further alternative embodiments, the first and second sensors may each comprise a camera, such as a video or time of flight camera. Such camera may directly view the shuttle arms and measure the position of the first shuttle arms along their shuttle paths. In even further alternative embodiments, any type of sensor capable of determining the position of the shuttle arms along their shuttle paths may be used.

As the shuttle arms 60 and 72 move during operation, the sensors 160 and 162 continuously send measured parameters to the controller. Using the received parameters, the controller continually compares the position of the first shuttle arm 60 to the position of the second shuttle arm 72 to determine if the shuttle arms 60 and 72 are misaligned. Misalignment typically occurs if one shuttle arm 60 or 72 is moving faster than the other.

One shuttle arm 60 or 72 may move slower than the other shuttle arm, because such shuttle arm experiences more resistance. For example, the angle at which the drill frame 36 is titled about one or more of its axes may vary the amount of resistance encountered by each shuttle arm 60 and 72. Typically, the drill frame 36 will be tilted at an angle so that the second pipe loader assembly 52 is lower than the first pipe loader assembly 50, as shown in FIG. 2. As a result, the second shuttle arm 72 may carry more of a pipe section's weight than the first shuttle arm 60, leading to more resistance applied to the second shuttle arm 72 than the first shuttle arm 60.

Because misalignment is typically a result of one shuttle arm 60 or 72 moving faster than the other, the controller is configured to calculate a velocity at which each shuttle arm 60 and 72 is moving using the received parameters. In order to re-align the shuttle arms 60 and 72, the controller may change the velocity at which one of the shuttle arms 60 and 72 is moving. The controller may control the velocity of each shuttle arm 60 and 72 by varying the flow rate of hydraulic fluid delivered to each hydraulic motor 110. For such reason, each hydraulic motor 110 may utilize its own hydraulic circuit. Over time, the controller may learn the optimal flow rate to send to each hydraulic motor 110 to keep the shuttle arms 60 and 72 aligned.

Figure 15:
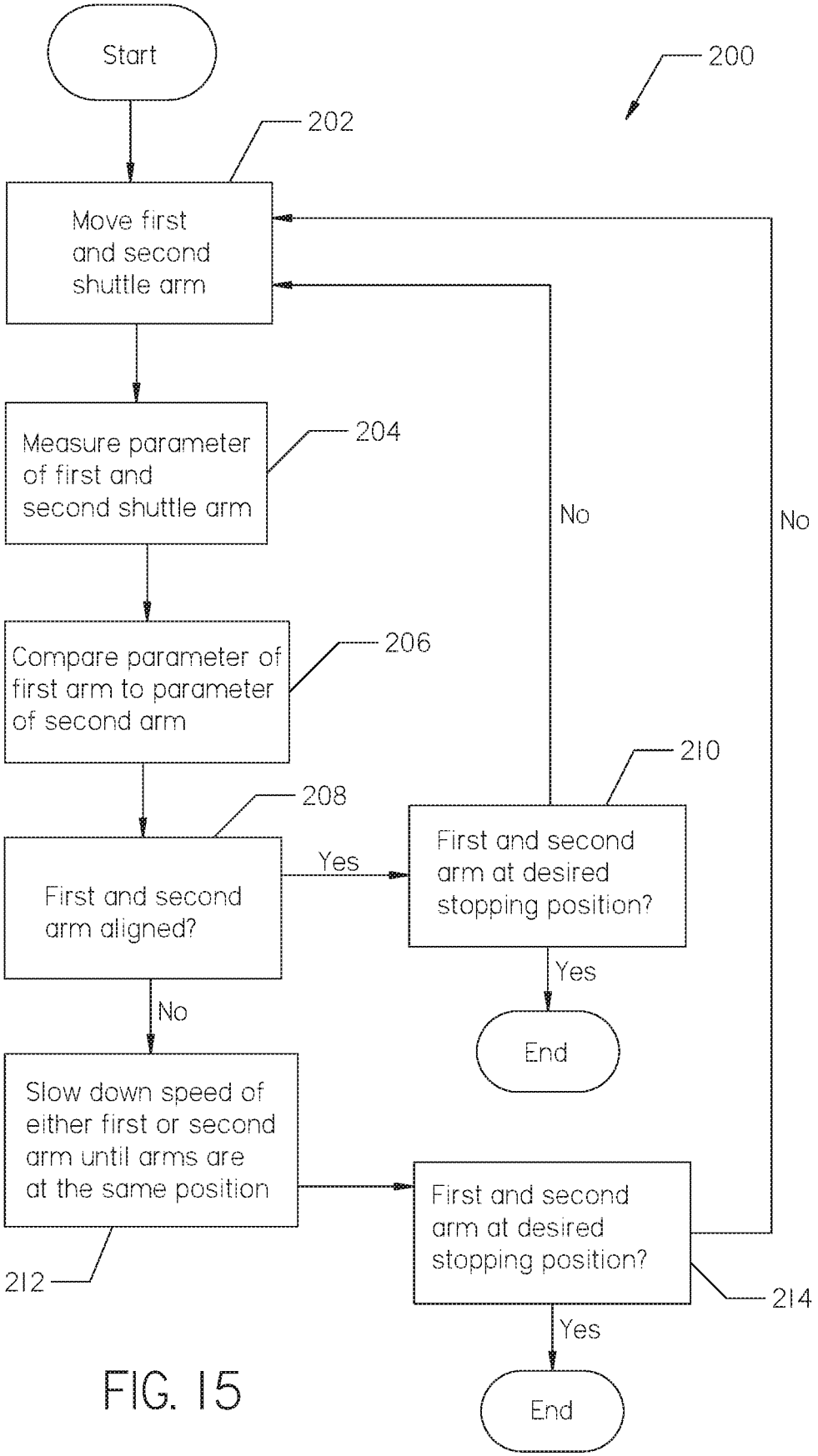
FIG. 15 is a flow chart depicting a method for re-aligning misaligned shuttle arms.

With reference to FIG. 15, a method 200 of handling misalignment is shown. The method 200 involves realigning the shuttle arms 60 and 72 once they become misaligned. To start, the first and second shuttle arms 60 and 72 are moved, as shown by step 202. The sensors 160 and 162 measure a first and second parameter for the shuttle arms 60 and 72, as shown by step 204. The measured parameters are transmitted to the controller for comparison, as shown by step 206.

If the shuttle arms 60 and 72 are determined to be aligned, the process will continue until the shuttle arms 60 and 72 reach their stopping position, as shown by steps 208 and 210. If the shuttle arms 60 and 72 are determined to be misaligned, the controller will determine the velocity at which each shuttle arm 60 and 72 is moving. The controller will then direct the faster moving shuttle arm 60 or 72 to slow down until the slower moving shuttle arm 60 or 72 catches up, as shown by step 212.

The faster moving shuttle arm 60 or 72 is instructed to slow down because the shuttle arms are typically moving at full speed. However, if the shuttle arms 60 and 72 are not moving at full speed, the controller may instruct the slower moving shuttle arm 60 or 72 to speed up to catch the faster moving shuttle arm. Such process will continue until the shuttle arms 60 and 72 reach their desired position, as shown by step 214.

Figure 16:
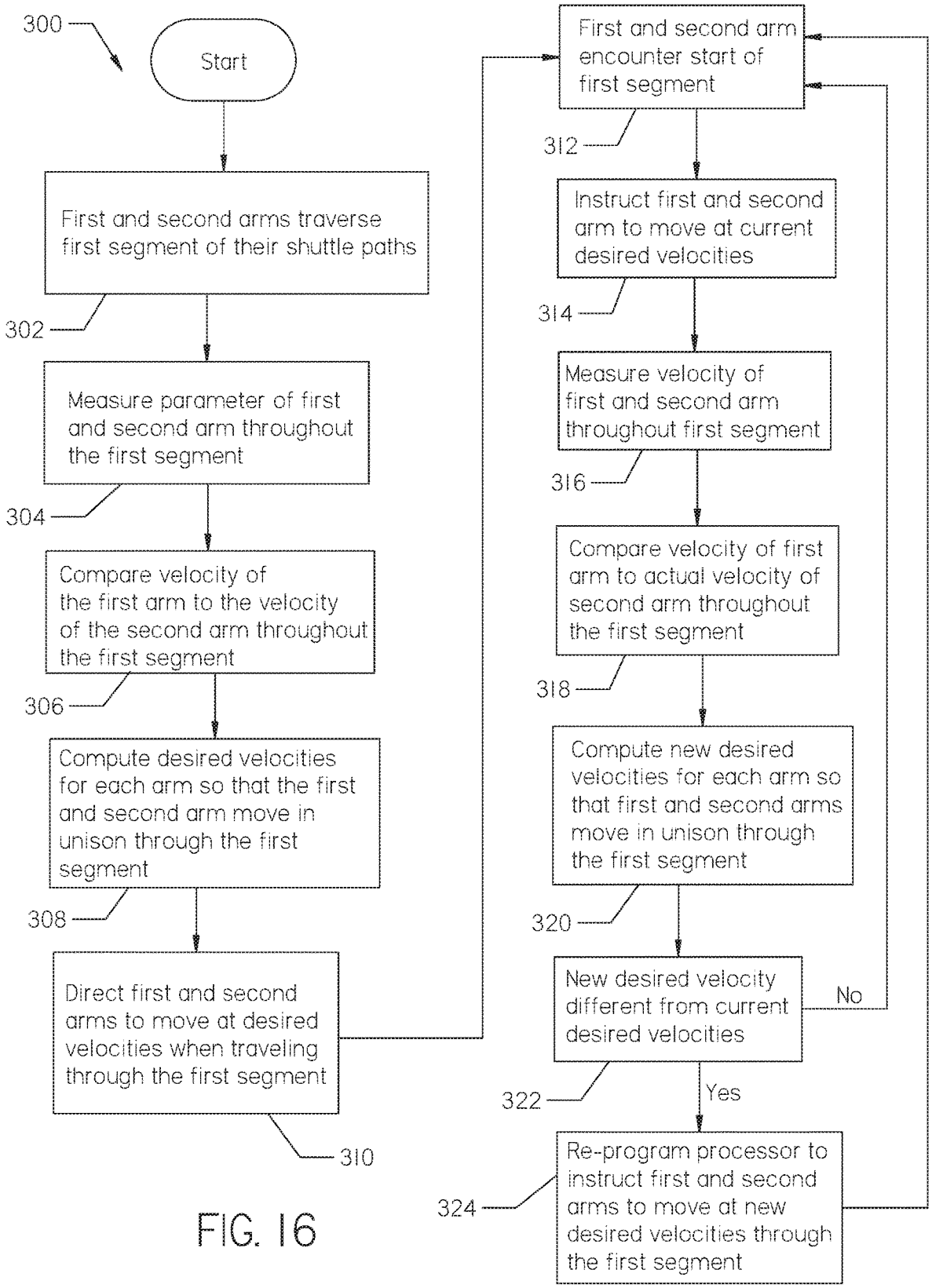
FIG. 16 is a flow chart depicting a method for preventing the shuttle arms from becoming misaligned.

With reference to FIG. 16, another method 300 of handling misalignment of the shuttle arms 60 and 72 is shown. The goal of the method 300 is to prevent the shuttle arms 60 and 72 from becoming misaligned, rather than correcting misalignment on the fly. Such goal is accomplished using dynamic feedback.

During operation, the controller can detect areas where one of the shuttle arms 60 or 72 may continually encounter resistance. Such resistance is detected by determining the velocity of each of the first and second shuttle arms 60 and 72 at successive positions along their respective shuttle paths. If one of the shuttle arms 60 or 72 moves slower than the other shuttle arm 60 or 72 through a certain segment of its shuttle path, the velocity of the faster moving shuttle arm is decreased within that segment. Alternatively, the velocity of the slower moving shuttle arm 60 or 72 may be increased within that segment.

To start, the first shuttle arm 62 performs a first traverse of a first segment of the first shuttle path, as shown by step 302. Simultaneously, the second shuttle arm 72 performs a first traverse of a first segment of the second shuttle path, as shown by step 302. The parameters measured by the sensors 160 and 162 during movement of the shuttle arms 60 and 72 are transmitted to the controller for analysis, as shown by step 304. The controller compares the velocity at which the first shuttle arm 60 traversed the first segment of the first shuttle path to the velocity at which the second shuttle arm 72 traversed the first segment of the second shuttle path, as shown by step 306. Based on such comparison, the controller computes desired velocities for each shuttle arm 60 and 72 to traverse the first segment of each shuttle path so that the shuttle arms 60 and 72 stay aligned, as shown by step 308.

The controller directs the actuators 104 to move the shuttle arms 60 and 72 at the computed velocities each time the shuttle arms 60 and 72 traverse the first segment of their respective shuttle paths, as shown by steps 310, 312, and 314. The sensors 160 and 162 continually measure parameters related to the position of the shuttle arms 60 and 72 each time the shuttle arms 60 and 72 traverse the first segment of their respective paths, as shown by step 316. If the controller determines that the shuttle arms 60 and 72 are ever misaligned, the controller will calculate new velocities for each shuttle arm 60 and 72 to move at through the first segment of their respective shuttle paths, as shown by steps 318, 320, 322, and 324. Such process will continue throughout the drilling operation.

The segments of the shuttle paths analyzed using the method 300 may be referred to as calibration zones. The controller may be configured to analyze and calculate desired velocities for the shuttle arms 60 and 72 to move at for multiple calibration zones throughout the shuttle paths. The calibration zones may correspond to the paths traveled by the shuttle arms 60 and 72 when loading or unloading pipe sections 18 from each column of the pipe box 54.

For example, when unloading pipe sections 18 from the pipe box 54, a first calibration zone may comprise forward movement of the shuttle arms 60 and 72 from the first column of the pipe box 54 to the carriage 42. A second calibration zone may comprise forward movement of the shuttle arms 60 and 72 from the second column of the pipe box 54 to the carriage 42, and so on.

When loading pipe sections into the pipe box 54, a first calibration zone may comprise rearward movement of the shuttle arms 60 and 72 from the carriage 42 to the third column of the pipe box 54. A second calibration zone may comprise rearward movement of the shuttle arms 60 and 72 from the carriage 42 to the second column of the pipe box 54, and so on.

The controller may pick which zones to analyze along the shuttle paths. Alternatively, an operator may set the zones for the controller. The first shuttle arm 60 may move at a different velocity in the first calibration zone as compared to the second calibration zone. Likewise, the second shuttle arm 72 may move at a different velocity through the first calibration as compared to the second calibration zone. The first shuttle arm 60, for example, may also move at a different velocity from the second shuttle arm 72 through the first calibration zone.

As discussed, the controller will continually analyze parameters received by the sensors 160 and 162 throughout the drilling operation. It may be necessary to continually recalibrate the velocity of the shuttle arms 60 and 72 within each calibration zone because the resistance applied to each shuttle arm 60 and 72 may vary throughout operation. For example, some pipe sections 18 may be positioned differently within the shuttle arms 60 and 72 or some pipe sections 18 may contain more mud than others, causing the pipe sections 18 to vary in weight. Alternatively, the angle of the pipe box 54 may vary over the course of the drilling operation. In alternative embodiments, the controller may average a series of recorded velocities for each calibration zones and instruct the actuators to move the shuttle arms at the average velocity for each calibration zone.

The calibration zones are only needed for those times when the shuttle arms 60 and 72 are carrying a pipe section 18. If the shuttle arms 60 and 72 are moving to a position to retrieve a pipe section 18, it is not necessary that the arms move in unison. As such, the first and second shuttle arms 60 and 72 may intentionally be moved at different speeds and times from one another.

In operation, the hydraulic motors 110 used to drive rotation of each pinion gear 108 use the same hydraulic pump. Thus, a shuttle arm 60 or 72 moves faster by itself, as compared to moving the shuttle arms 60 and 72 at the same time. As such, there may be instances where the drilling process can be made more efficient if the shuttle arms 60 and 72 are moved at different times.

Figure 17:
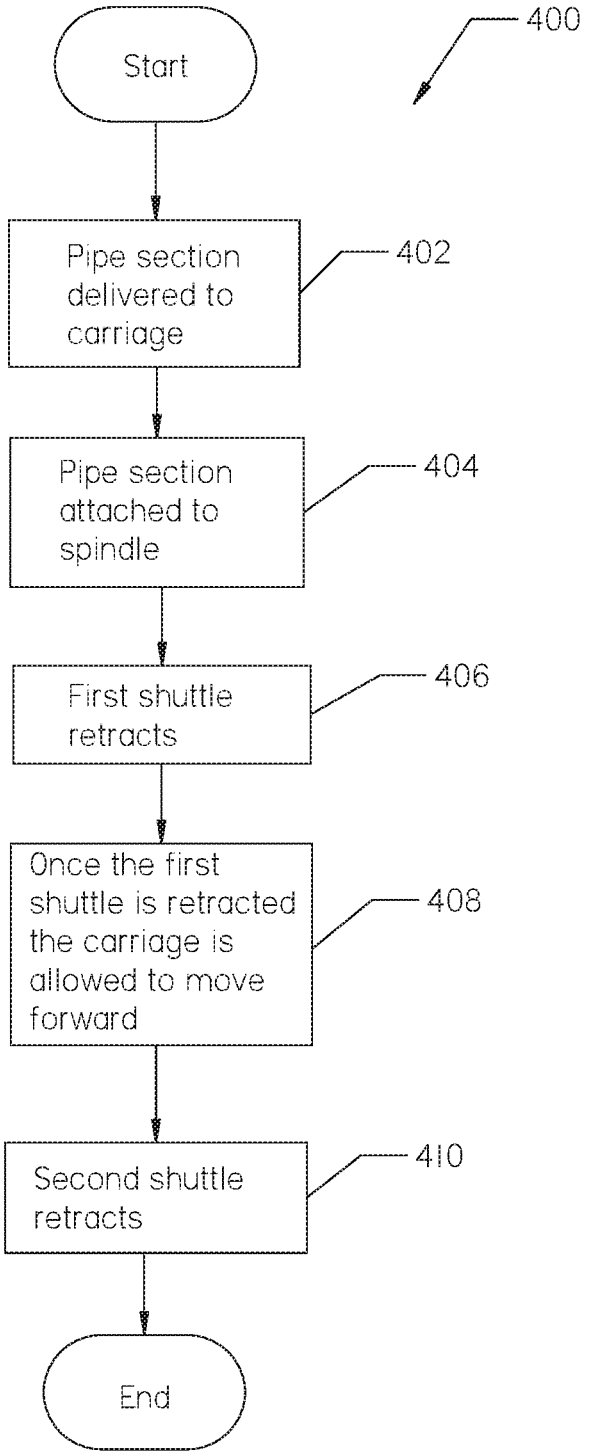
FIG. 17 is a flow chart depicting a method of using the shuttle arms independently while making up a drill string.

With reference to FIG. 17, a method 400 of operating the shuttle arms 60 and 72 independently while adding pipe sections 18 to the drill string 16 is shown. To start, the shuttle arms 60 and 72 deliver a pipe section 18 to the carriage 42, as shown by step 402. After the pipe section 18 is attached to the spindle 56, the first shuttle arm 60 may move rearward back to the pipe box 54, as shown by steps 404 and 406. Once the first shuttle arm 60 is out of the way of the carriage 42, the carriage 42 may move forward along the rail 58, as shown by step 408. The second shuttle arm 72 may start to move rearwardly once the first shuttle arm 60 is out of the way of the carriage 42, as shown by step 410. Alternatively, the second shuttle arm 72 may loosely grip the pipe section 18 as the carriage 42 moves forward to help guide the pipe section 18 towards the drill string 16.

Figure 18:
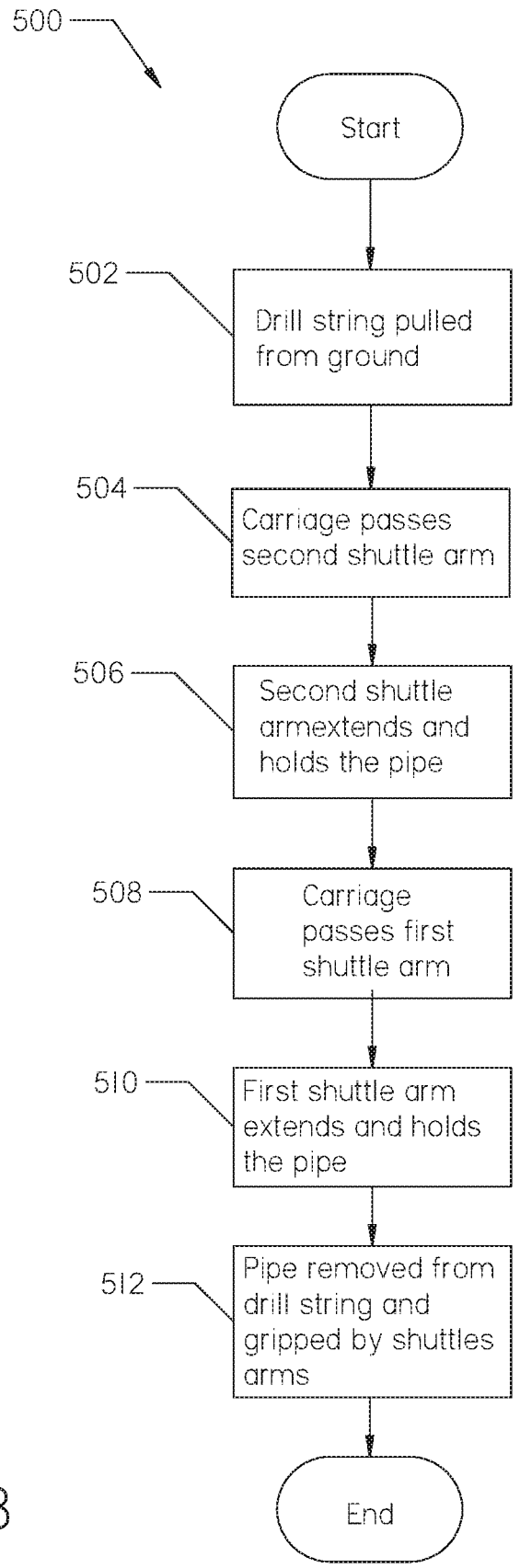
FIG. 18 is a flow chart depicting a method of using the shuttle arms independently while removing pipe sections from the drill string.

Turning to FIG. 18, a method 500 of operating the shuttle arms 60 and 72 independently while removing pipe sections 18 from the drill string 16 is shown. To start, the carriage 42 pulls the drill string 16 from the ground surface 12, as shown by step 502. Once the carriage 42 passes the second shuttle arm 72, the second shuttle arm 72 moves forward towards the drill frame 36 and holds the pipe section 18, as shown by steps 504 and 506. Likewise, once the carriage 42 passes the first shuttle arm 60, the first shuttle arm 60 moves forward towards the drill frame 36 and holds the pipe section 18, as shown by steps 508 and 501. After the wrenches 46 and spindle 56 remove the pipe section 18 from the drill string 16, the shuttle arms 60 and 72 grip the pipe section 18 and transport it to the pipe box 54 as shown by step 512. To save time, the wrenches 46 may unthread the pipe section 18 from the drill string 16 as only second shuttle arm 72 is holding the pipe section 18.

The shuttle arms 60 and 72 may also be configured so that they are selectively movable. The controller may include a user interface that allows an operator to independently move each shuttle arm 60 and 72 to a desired position at any time. For example, only one shuttle arm 60 or 72 may be moved forward towards the carriage 42 to hold a tool or a small pipe section.

The shuttle arms 60 and 72 may be configured to automatically move slower once the gripper 94 on each arm starts to move beneath the pipe box 54. The slower movement gives the operator time to change which column the shuttle arm 60 or 72 is moving towards, if needed.

The shuttle arms 60 or 72 may also be moved independently to help prepare the drilling machine 10 for transport. When transporting the drilling machine 10, it is beneficial to position the carriage 42 midway along the drill frame 36 in order to help balance the drilling machine 10. Such position of the carriage 42 may be referred to as a "transport position".

Figure 19:
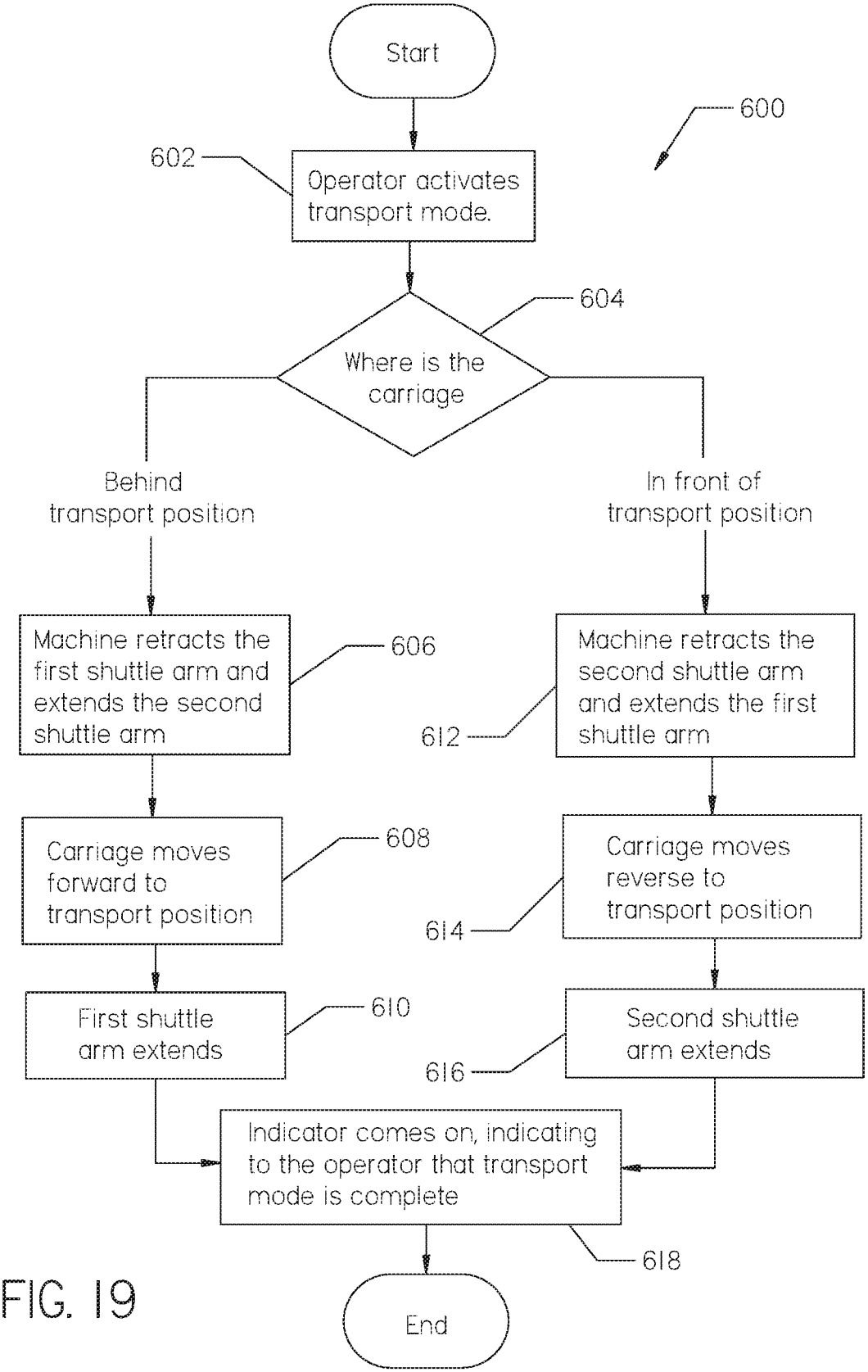
FIG. 19 is a flow chart depicting a method of using the shuttle arms independently while preparing the drilling machine for transport.

With reference to FIG. 19, a method 600 of operating the shuttle arms 60 and 72 independently in order to move the carriage 42 to the transport position is shown. To start, the drilling operator may activate transport mode, as shown by step 602. Transport mode may be activated on a user interface located at the operator station 32. Once activated, the controller determines where the carriage 42 is located along the drill frame 36, as shown by step 604.

If the carriage 42 is behind the transport position, the controller retracts the first shuttle 60 and extends the second shuttle 72, as shown by step 606. The carriage 42 then moves forward along the drill frame 36 to the transport position, as shown by step 608. Once the carriage 42 is at the transport position, the first shuttle arm 60 may extend, as shown by step 610. Following step 610, the controller notifies the drilling operator that carriage 42 is ready for transport, as shown by step 618.

If the carriage 42 is in front of the transport position, the controller retracts the second shuttle arm 72 and extends the first shuttle arm 60, as shown by step 612. The carriage 42 then moves rearward along the drill frame 36 to the transport position, as shown by step 614. Once the carriage 42 is at the transport position, the second shuttle arm 72 may extend, as shown by step 616. Following step 616, the controller notifies the drilling operator that carriage 42 is ready for transport, as shown by step 618.

Because the shuttle arms 60 and 72 can move independently, the arms 60 and 72 may also be used as weights to balance the drilling machine 10 during transport. For example, one shuttle arm 60 or 72 may be extended towards the carriage 42 while the other shuttle arm 60 or 72 is positioned beneath the pipe box 54.

Changes may be made in the construction, operation and arrangement of the various parts, elements, steps and procedures described herein without departing from the spirit and scope of the invention as described in the following claims.

The invention claimed is:

1. An apparatus, comprising:

an elongate frame having a longitudinal axis;

a first shuttle arm supported by the frame and movable along a first shuttle path transverse to the longitudinal axis of the frame;

a second shuttle arm supported by the frame and movable along a second shuttle path spaced from, but parallel to, the first shuttle path;

a first actuator configured to power movement of the first shuttle arm along the first shuttle path;

a second actuator configured to power movement of the second shuttle arm along the second shuttle path, independent of the first actuator;

in which each of the first and second actuators comprises a pinion; and in which the pinions are not mechanically coupled to one another, apart from any removable load transported by both the first and second shuttle arms;

a first sensor that periodically measures a first parameter that is either the position of the first shuttle arm or a parameter from which such position may be calculated;

a second sensor that periodically measures a second parameter that is either the position of the second shuttle arm or a parameter from which such position may be calculated; and a controller in communication with the first and second sensors and with the first and second actuators, the controller configured to evaluate the first and second parameters, and to issue commands to one or both of the first and second actuators in response to that evaluation.

2. The apparatus of claim 1, in which the controller is configured to evaluate the rate of change over time, if any, of each of the first and second parameters.

3. The apparatus of claim 1, in which the controller is configured to command the first and second actuators to operate in unison.

4. The apparatus of claim 1, in which the first shuttle path is perpendicular to the longitudinal axis of the frame; and in which the controller is configured to command the first and second actuators to move the first and second shuttle arms at different velocities.

5. The apparatus of claim 1, in which the first shuttle path is perpendicular to the longitudinal axis of the frame; and in which the controller is configured to command the first actuator to move the first shuttle arm and simultaneously command the second actuator to hold the second shuttle arm stationary.

6. The apparatus of claim 1, in which the first shuttle path is perpendicular to the longitudinal axis of the frame; and in which the first shuttle path comprises a first segment and a second segment, and in which the controller is configured to command the first actuator to move the first shuttle arm through the second segment at a different velocity than that at which the first actuator moves the first shuttle arm through the first segment.

7. The apparatus of claim 6, in which the second shuttle path comprises a first segment and a second segment, and in which the controller is configured to command the second actuator to move the second shuttle arm through the second segment at a different velocity than that at which the second actuator moves the second shuttle arm through the first segment.

8. The apparatus of claim 7, in which the first segment of the first shuttle path aligns with the first segment of the second shuttle path, and in which the second segment of the first shuttle path aligns with the second segment of the second shuttle path.

9. The apparatus of claim 1, in which each of the first and second actuators further comprises a hydraulic motor used to power rotation of that actuator's pinion.

10. The apparatus of claim 1, in which each of the first and second sensors comprises an encoder.

11. The apparatus of claim 10, in which the encoder is a rotary encoder.

12. The apparatus of claim 1, in which the first sensor is supported on the frame in a spaced relationship to the first actuator.

13. The apparatus of claim 1, in which the first sensor engages the first actuator.

14. A horizontal boring machine, comprising:

the apparatus of claim 1; and a carriage supported on the frame and movable between a first and second end of the frame.

15. The horizontal boring machine of claim 14, further comprising:

a spindle supported on the carriage; and a pipe box supported on the frame; in which the first and second shuttle arms are movable between the pipe box and the spindle.

16. The horizontal boring machine of claim 14, further comprising:

an operator station supported on the frame;

in which the controller is located at the operator station.

17. A method of using an apparatus, the apparatus comprising:

an elongate frame having a longitudinal frame axis;

a first shuttle arm supported by the frame and movable along a first shuttle path traverse to the frame axis; and a second shuttle arm supported by the frame and movable along a second shuttle path spaced from, but parallel to, the first shuttle path;

in which the first and second shuttle arms are not mechanically coupled to one another, apart from any removable load transported by both shuttle arms;

the steps comprising:

independently moving each of the first and second shuttle arms relative to the frame;

determining the velocity of each of the first and second shuttle arms at successive positions along their respective shuttle paths; and in response to the determinations of velocity, modifying the velocity of one or more of the shuttle arms.

18. The method of claim 17, in which the step of moving the first and second shuttle arms relative to the frame comprises:

causing the first shuttle arm to perform a first traverse of a first segment of the first shuttle path; and simultaneously with the first traverse by the first shuttle arm, causing the second shuttle arm to perform a first traverse of a first segment of the second shuttle path;

in which the steps of determining the velocity of each of the first and second shuttle arms comprises:

during a second traverse, equalizing the velocity of each shuffle arm with that observed for that arm during the first traverse at the same position.

* * * * *